US010322871B2

(12) United States Patent
Terry et al.

(10) Patent No.: US 10,322,871 B2
(45) Date of Patent: Jun. 18, 2019

(54) MICRONIZED DRY BARITE POWDER BULK MOVEMENT

(71) Applicant: HALLIBURTON ENERGY SERVICES, INC., Houston, TX (US)

(72) Inventors: Keith Allan Terry, Spring, TX (US); Brian Daniel O'Connell, Houston, TX (US); Julian Coward, Houston, TX (US); Rob Charles Valenziano, Magnolia, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 3 days.

(21) Appl. No.: 15/325,705

(22) PCT Filed: Aug. 3, 2015

(86) PCT No.: PCT/US2015/043442
§ 371 (c)(1),
(2) Date: Jan. 11, 2017

(87) PCT Pub. No.: WO2016/022480
PCT Pub. Date: Feb. 11, 2016

(65) Prior Publication Data

US 2017/0158426 A1 Jun. 8, 2017

Related U.S. Application Data

(60) Provisional application No. 62/033,559, filed on Aug. 5, 2014.

(51) Int. Cl.
*B65D 88/30* (2006.01)
*B65D 88/72* (2006.01)
(Continued)

(52) U.S. Cl.
CPC ..... *B65D 88/72* (2013.01); *B65D 88/30* (2013.01); *B65D 88/54* (2013.01); *B65D 90/10* (2013.01); *E21B 21/06* (2013.01)

(58) Field of Classification Search
CPC ..... B65D 88/72
See application file for complete search history.

(56) References Cited

U.S. PATENT DOCUMENTS 1,684,320 A * 9/1928 Ewald ..... B65G 33/04 406/101
2,048,139 A * 7/1936 Porteous ..... F23K 3/00 222/242

(Continued)

FOREIGN PATENT DOCUMENTS

EP 1918227 5/2008

OTHER PUBLICATIONS

PCT International Search Report and Written Opinion, dated Nov. 23, 2015, Appl No. PCT/US2015/043442, "Micronized Dry Barite Powder Bulk Movement" Filed Aug. 3, 2015, 16 pgs.

*Primary Examiner* — William R Harp
(74) *Attorney, Agent, or Firm* — Polsinelli PC

(57) ABSTRACT

An apparatus includes a superstructure including cylindrical vessel with a conical bottom section and an opening near the base of the cone; an air assisted puffer device near the base of the cone; an air blower attached near the base of the cone, wherein the air blower is configured to produce air velocities of at least about 40 ft/min; a gently sweeping elbow attached after the blower exit; and a hatch fitted to the top of the vessel that allows for a funnel to be connected to the tank thereby allowing bulk barite powder to be loaded into the top of the tank from bulk bags. A barite powder blend including: a blend of barite particles with a size of about 1 micron and barite particles with a size of at least about 325 mesh,
(Continued)

wherein the D50 of the blend is not greater than about 325 mesh.

12 Claims, 26 Drawing Sheets

(51) Int. Cl.
*B65D 88/54* (2006.01)
*B65D 90/10* (2006.01)
*E21B 21/06* (2006.01)

(56) References Cited

U.S. PATENT DOCUMENTS 2,584,919 A * 2/1952 Pullar ..... C08K 3/30 106/279
2,644,722 A * 7/1953 Childress ..... B65G 53/66 137/875
3,223,457 A * 12/1965 Douglas ..... B65D 88/72 406/138
3,756,475 A * 9/1973 Emery ..... B01F 13/0255 222/195
4,184,771 A 1/1980 Day
4,459,070 A * 7/1984 Bourgeois ..... B65G 53/22 105/247
4,746,250 A * 5/1988 Schoppe ..... B01F 3/06 222/331
10,093,844 B2 * 10/2018 Bouguetta ..... B65G 53/16
2003/0223827 A1 12/2003 Tilley
2007/0105725 A1 5/2007 Massam et al.
2008/0107513 A1 5/2008 Curtis et al.
2008/0108528 A1 5/2008 Matlock et al.
2009/0110529 A1 * 4/2009 Browne ..... B65G 53/16 414/676
2014/0051607 A1 2/2014 Massam et al.
2017/0029685 A1 * 2/2017 Bouguetta ..... B65G 53/16

* cited by examiner

MICRONIZED DRY BARITE POWDER BULK MOVEMENT

CROSS-REFERENCE TO RELATED APPLICATIONS

This application claims the benefit of U.S. Provisional Patent Application No. 62/033,559, filed on Aug. 5, 2014, the entire contents of which are incorporated by reference herein.

BACKGROUND

During the drilling and completion of oil and gas wells, various wellbore treating fluids are used for a number of purposes. For example, high viscosity gels are used to create fractures in oil and gas bearing formations to increase production. High viscosity and high density gels are also used to maintain positive hydrostatic pressure in the well while limiting flow of well fluids into earth formations during installation of completion equipment. High viscosity fluids are used to flow sand into wells during gravel packing operations. The high is viscosity fluids are normally produced by mixing dry powder and/or granular materials and agents with water at the well site as they are needed for the particular treatment systems for metering and mixing the various materials.

In order to prevent formation fluids from entering the wellbore, the hydrostatic pressure of the drilling fluid column in the wellbore should be greater than the pressure of the formation fluids. The hydrostatic pressure of the drilling fluid column is a function of the density of the drilling fluid and depth of the wellbore. Accordingly, density is an important property of the drilling fluid for preventing the undesirable flow of formation fluids into the wellbore. To provide increased density, weighting agents are commonly included in drilling fluids. Weighting agents are typically high-specific gravity, finely ground solid materials. As referred to herein, the term "high-specific gravity" refers to a material having a specific gravity of greater than about 2.6. Examples of suitable weighting agents include, but are not limited to, barite, hematite, ilmentite, manganese tetraoxide, galena, and calcium carbonate.

As wellbores are being drilled deeper, the pressure of the formation fluids increases. To counteract this pressure increase and prevent the undesired inflow of formation fluids, a higher concentration of weighting agent may be included in the drilling fluid. However, increasing the concentration of weighting agent may be problematic. For example, as the concentration of the weighting agent increases, problems with particle sedimentation may occur (often referred to as "sag"). Among other things, particle sedimentation may result in stuck pipe or a plugged annulus. Particle sedimentation may be particularly problematic in directional drilling techniques, such as horizontal drilling. In addition to particle sedimentation, increasing the concentration of the weighting agent also may increase the viscosity of the drilling fluid, for instance. While viscosification of the drilling fluid may be desired to suspend drill cuttings and weighting agents therein, excessive viscosity may have adverse effects on equivalent circulating density. For example, an increase in the equivalent circulating density may result in an excessive increase in pumping requirements for circulation of the drilling fluid in the well bore.

Several techniques have been utilized to prevent undesired particle sedimentation while providing a drilling fluid with desirable rheological properties. For instance, decreasing the particle size of the weighting agent should create finer particles, reducing the tendency of the particles to settle (SAG). However, the increased number of particles of a reduced particle size may also cause an excessive increase in viscosity. One approach to reducing particle size while maintaining desirable rheology involves utilizing particles of a reduced size while limiting the number of particles that are very fine (below about 1 micron).

The powder or granular treating material is normally transported to a well site in a commercial or common carrier tank truck. Once the tank truck and mixing system are at the well site, the dry powder material must be transferred or conveyed from the tank truck into a supply tank for metering into a mixer as needed. The dry powder materials are usually transferred from the tank truck pneumatically. The dry powder may also be transported in bags, which are loaded into a hopper and then transferred to the mixing apparatus.

Many problems complicate the transference of fines (particles with an effective diameter less than about 6 μm). Typically, as fines are stored, they have a natural tendency to self-compact. Compaction occurs when the weight of an overlying substance results in the reduction of porosity by forcing the grains of the substance closer together, thus expelling fluids (e.g., water), from the pore spaces. However, when multiple substance fines are intermixed, compaction may occur when a more ductile fine deforms around a less ductile fine, thereby reducing porosity and resulting in compaction.

Pneumatic transport of micronized (less than 10 micron particle size) barite powder using conventional means also suffers complications due to the resulting introduction of moisture and the tendency of micronized barite to adhere to surfaces.

BRIEF DESCRIPTION OF THE DRAWINGS

The following figures are included to illustrate certain aspects of the present disclosure, and should not be viewed as exclusive embodiments. The subject matter disclosed is capable of considerable modification, alteration, and equivalents in form and function, as will occur to one having ordinary skill in the art and having the benefit of this disclosure.

DETAILED DESCRIPTION

Figure 1:
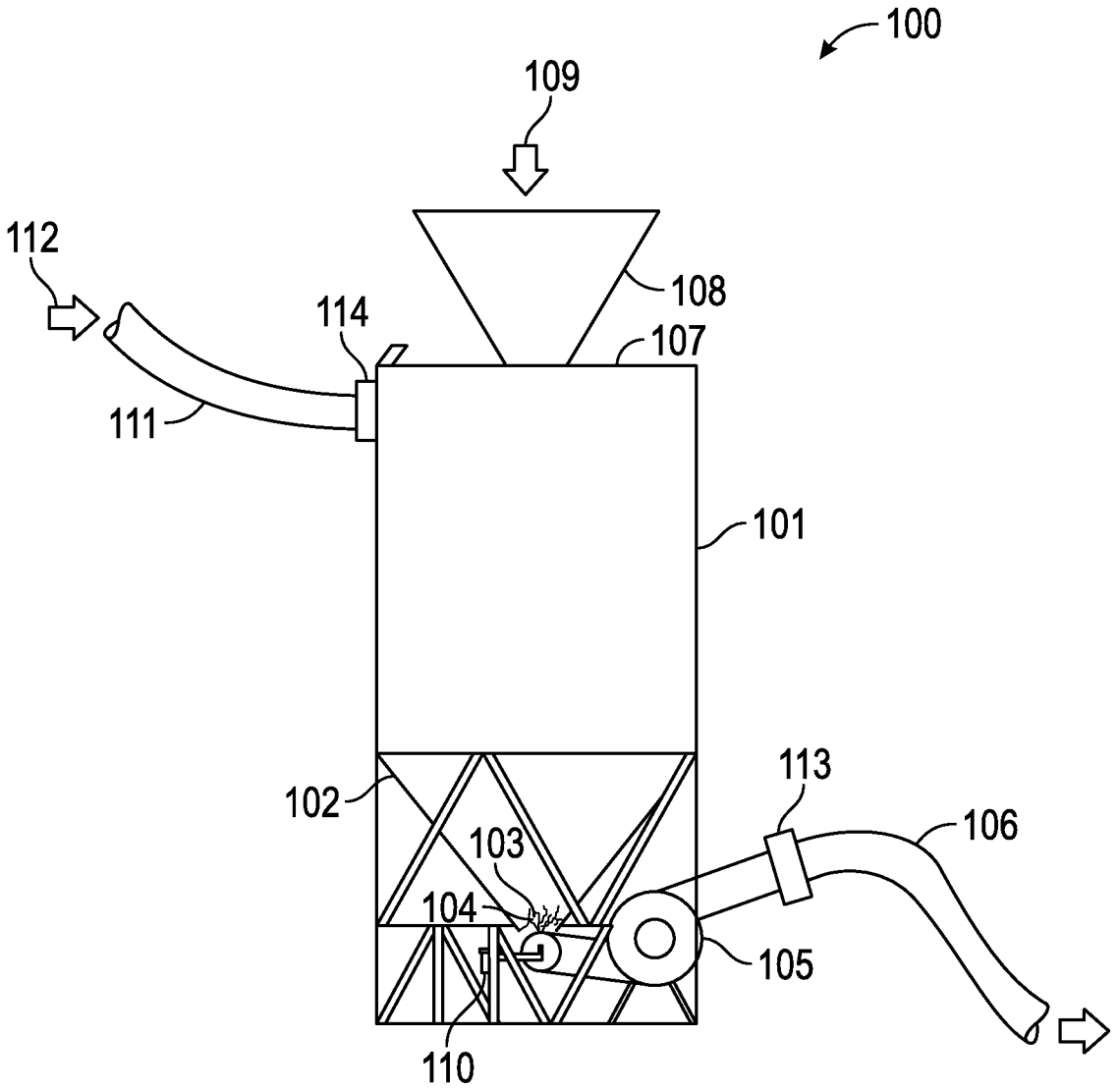
FIG. 1 depicts an embodiment of an apparatus for transporting bulk barite.

Generally, the disclosure is directed to self-contained vessels (tank and powered blower apparatus) specifically designed for optimizing the transport of micronized barite particles in the dry state using (high speed) pneumatic flow. The disclosure is also directed to blends of barite by particle size to allow standard pneumatic transport.

In some embodiments, an apparatus comprising a superstructure includes a cylindrical vessel with a conical bottom section and an opening near the base of the cone; an air assisted puffer device (spider configuration) attached to the superstructure near the base of the cone; an air blower (with pulsing line activation for the spider) attached near the base of the cone, wherein the air blower is configured to produce air velocities of at least about 40 ft/min (in some embodiments, about 55 to about 75 ft/min); a gently sweeping elbow (for connecting flexible hose) attached after the blower exit; and a hatch fitted to the top of the vessel thereby allowing bulk barite powder to be loaded into the top of the tank from bulk bags (with a design allowing attachment or removal of the conical hopper through a sealed opening). The tank may be fitted with a removable funnel shaped hopper with square top slightly larger than a 1 metric ton FIBC bag), wherein the hatch fitted to the top of the vessel allows for a funnel to be connected to the tank, thereby allowing bulk barite to be loaded into the top of the tank from bulk (ISO FIBC) bags.

The conical bottom may have sides at an angle in the range of about 30 degrees to about 60 degrees to the horizontal. In some embodiments, the angle is about 50 degrees. The blower air velocity may be in the range of about 55 ft/min to about 95 ft/min and the blower may be attached as an integral unit within the confines of the tank base superstructure which supports the tank. In some embodiments, the apparatus will further comprise a diverter valve at the base of the tank, allowing the blower to vent without loss or movement of barite powder if the tank is being loaded and to adjust the flow rate of barite powder from the tank. This valve may also be fitted with a gauge to measure the volume of barite entering the line so that flow may be optimized for fine particle efficient movement.

The apparatus may also further comprise a hose connection in the upper section configured to allow for loading powder from another tank of similar design with the design creating a vacuum upon the hose connection when in its open configuration. The gently sweeping elbow may have an angle from about 15 degrees up to about 90 degrees and allow the elbow to be disconnected and exchanged for elbows of varying sweeping angles. In some embodiments, the apparatus may further comprise a power system to operate the blower which may be powered by air pressure (such as a turbine type power head or by electricity such as a blower type power head). The power head may be exchangeable based on requirements of the operational location. The funnel is (detachable hopper) and discharge funnel (integral to the tank) may be made of metal or any other appropriate material. Further, the funnel (detachable hopper for the top of the tank) may include an apparatus, such as a sharp blade, for cutting the bulk sacks as they are placed onto the hopper for barite loading. The hopper may be fitted with a square entry lip (in the shape of the FIBC bag) to allow proper alignment of the bulk bag and provide a pressure seal to reduce barite powder loss during loading.

In some embodiments, a method of conveying bulk barite comprises: loading bulk barite into an apparatus, wherein the bulk barite comprises particles at least about 1 micron in size at D50 distribution up to about 6 microns in size at D50 distribution, said apparatus including: a cylindrical vessel with a conical bottom section and an opening near the base of the cone; an air assisted puffer device (spider configuration) near the base of the cone; a power head air blower attached near the base of the cone, wherein the air blower produces air velocities of at least about 40 ft/min and, in some embodiments, between about 55 ft/min and about 95 ft/min; a gently sweeping elbow (of varying degrees from about 0 to about 90 degrees) attached after the blower exit; and a hatch fitted to the top of the vessel thereby allowing bulk barite to be loaded into the top of the tank from bulk bags; and conveying the bulk barite through the diverter valve into the high speed airflow provided by the blower and through the gently sweeping elbow.

The tank may further comprise a funnel, wherein the hatch fitted to the top of the vessel allows for a funnel (bulk bag hopper with square top to match the shape of the FIBC bags and provide a pressure seal from the bag to the hopper (funnel) to be connected to the tank, thereby allowing bulk barite to be loaded into the top of the tank from FIBC bulk bags. The conical bottom may have sides at an angle in the range of about 30 degrees to about 60 degrees to the horizontal. In a preferred embodiment, the angle is about 50 degrees. The blower air velocity may be as low as about 40 ft/min but, in some embodiments between about 55 ft/min to about 95 ft/min. In some embodiments, the method may further comprise a diverter valve at the base of the tank, allowing the blower to be operated to vent without loss or movement of barite powder if the tank is being loaded, allow variable volume flow out of the tank and measure the flow of barite out of the tank and into the line and/or allow diverting the blower or closing the tank while loading the tank.

The method may further comprise a hose connection in the top ⅓ section of the tank apparatus, configured to allow for loading powder from another tank of similar design, and/or loading powder from above using gravity flow. The gently sweeping elbow may have an angle of up to 90 degrees but may be interchangeable with a gently sweeping elbow from about 0 degrees up to about 90 degrees. In some embodiments, the method may further comprise an apparatus including a power system to operate the blower which is associated with the superstructure which holds the tank apparatus.

The method may further comprise an apparatus on the top of the tank; a funnel (conical hopper with rectangular top) for cutting the bulk FIBC sacks of up to about 1.5 metric tons, and cutting the bulk sacks as they are lowered onto the square lip with sides built into the conical hopper (funnel). The cutting apparatus may comprise a sharp blade which may be mounted into the conical hopper (funnel) such that when the FIBC bulk bag is lowered onto the square lip of the conical hopper (funnel) that the center of the bag will be pierced to allow powder to flow by gravity and some generated vacuum (if desired) into the tank. The size of bulk barite particles is variable may be as small as a blend of barite particles with a D50 size of between about 1 and about 6 microns up to a blend of barite particle sizes with the largest D50 size of no greater than about 325 mesh.

In some embodiments, a barite powder blend comprises: a blend of barite particles with a size of about 1 micron and barite particles with a size of at least about 325 mesh, wherein the D50 of the blend is not greater than about 325 mesh. Similar embodiments allow use of D50 micron sizes from a minimum of about 1 micron to a blend of small micron sizes up to a blend no greater than about 325 mesh. Any size of D50 between about 1 micron and about 325 mesh may be included.

In other embodiments, a well treatment system comprises: a well treatment apparatus including a conveying system, configured to pneumatically convey bulk barite including: a cylindrical vessel with a conical bottom section and an opening near the base of the cone; an air assisted puffer device (spider) near the base of the cone; a power head air blower attached near the base of the cone, wherein the air blower is configured to produce air velocities of at least about 40 ft/min up to about 95 ft/min; a gently sweeping elbow from about 0 degrees to about 90 degrees attached after the blower exit; and a hatch fitted to the top of the vessel that allows for a funnel (cylindrical hopper with rectangular shaped top lip to match slightly larger than the shape configuration of a 1 metric ton to 1.5 metric ton FIBC bulk bag) to be connected to the tank thereby allowing bulk barite to be loaded into the top of the tank from bulk bags pierced as they are lowered onto the square lip on top of the funnel, wherein the bulk barite comprises particles at least about 1 micron in size at D50 distribution up to about 6 microns in size at D50 distribution.

Referring to FIG. 1, an apparatus for transferring bulk barite is shown in accordance with embodiments of the disclosure. In the embodiment shown in FIG. 1, the apparatus for transferring bulk barite 100 includes a tank body 101 with a conical bottom section 102 with an opening 103. At the base of the cone 102, inside the tank, an air assisted puffer device (spider) 104 may be in place as a part of the tank to assist in flowing the material near the opening 103. An air blower 105 may be attached to the base of the cone 102 under the tank. The air blower 105 may provide airflow of at least about 40 ft/min up to about 95 feet per minute directly down the line exiting the tank 106. In addition, a small hose (not shown) may be attached to the exit of the blower 105 to provide forced air into the air assisted puffer device 104 inside of the tank (a small pulsing valve may be installed from the blower line that oscillates flow to actuate the puffers (spider) inside the funnel at the base of the tank). A gently sweeping elbow 106 of from about 0 degrees up to about 90 degrees may follow the blower exit to the base of the tank frame complete with an airlock hose connector 113. There may be a diverter valve 110 at the base of the tank that allows the blower 105 to be operated to vent without loss or movement of any barite powder if the tank is being loaded via pneumatics and control release of barite volume also allowing variation and measurement of the volume of barite being rendered from the tank.

The tank may also include a hose connection 114 in the upper section to allow for loading with bulk powder 112 through a hose 111 from another tank of the same design or by gravity feed from barite located in a tank above this tank. The top of the tank may be fitted with a specially designed hatch 107 that allows for an optional funnel (conical hopper with rectangular top slightly larger in configuration than the shape of a 1 or 1.5 metric ton FIBC bulk bag). 108 to be connected to the tank so that bulk barite may be loaded directly into the top of the tank 109 from bulk bags cut into the funnel 109. The funnel 109 may be made of metal. Further, the funnel 109 may include an apparatus, such as a sharp blade, mounted in the center of the funnel (conical hopper with rectangular top slightly larger in configuration than the shape of a 1 or 1.5 metric ton FIBC bulk bag) for cutting the bulk sacks. The tank may be operated with the funnel 108 attached or detached as desired. The tank and power unit together may be of a self-contained design, thereby allowing a smaller footprint and easier transport of the equipment.

The bulk transport system 100 receives bulk barite, stores bulk barite, and transports bulk barite for use in drilling operations, or to transport barite to other storage tanks. The bulk barite system 100 may receive barite through a hose connection 114 in the upper section to allow for loading with bulk powder 112 through a hose 111 from another tank of similar design or by gravity feed from a tank located above said tank. A diverter valve 110 at the base of the tank would allow the blower 105 to be operated to vent without loss or movement of any barite powder when the tank is being loaded via pneumatics and to allow variable discharge of barite powder from the tank while discharging and allowing gauging of the flow of barite powder from said tank. Loading barite into the tank may also use the hatch 107 on top of the tank. Bags of bulk barite may include a spout that fits inside of the hatch. Further, an optional funnel (conical hopper with rectangular top slightly larger in configuration than the shape of a 1 or 1.5 metric ton FIBC bulk bag) 108 may be connected to the tank so that bulk barite may be loaded into the top of the tank 109 from bulk bags cut into the funnel (conical hopper with rectangular top slightly larger in configuration than the shape of a 1 or 1.5 metric ton FIBC bulk bag) 109. Additionally, the funnel 109 may include an apparatus, such as a sharp blade, for cutting the bulk sacks. Once the barite is in the tank, it may be stored there until an appropriate step in a process. Alternatively, the barite may be pneumatically transferred to another vessel using the blower 105. The storage tanks may be either on land, on trucks, transported at sea on boats, and/or located on the deck of offshore rigs, platforms, barges, or drill ships.

Another embodiment is directed to the use of multiple tanks and moving a lighter weight empty tank to a rig floor while conveying dry barite from one about 25 ton tank on a vessel to another empty tank on the rig until the complete bulk load and multiple full tanks are on the rig for use. The size and is rigidity of the tanks less than about 25 tons fully loaded to allow efficient bulk transport and possibly transport of full tanks to the rig floor when rig capacity is able to move up to about 25 tons of dry weight.

Figure 2:
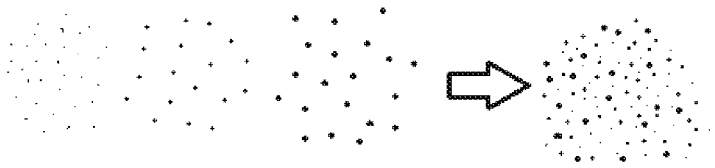
FIG. 2 is a sketch of blended barite with different particle size additions.

The disclosure also describes a blend of micronized powder of about 1 micron to about 6 microns and larger particles to create a final powder of up to about 325 mesh at particle size distribution D50 so that standard pneumatic equipment available to the industry may be used to transport the barite powder pneumatically without the use of the unique tank design identified in earlier disclosures. This material blend disclosure allows the use of standard dry barite powder pneumatic transport equipment. A schematic sketch of this blend is shown in FIG. 2. The combination of barite powders may allow movement in standard configuration equipment. An exemplary barite powder blend may comprise: a blend of barite particles with a size of about 1 micron and barite particles with a size of at least about 325 mesh, wherein the D50 of the blend is not greater than about 325 mesh. This blend may also be used in the apparatus described above.

Figure 3:
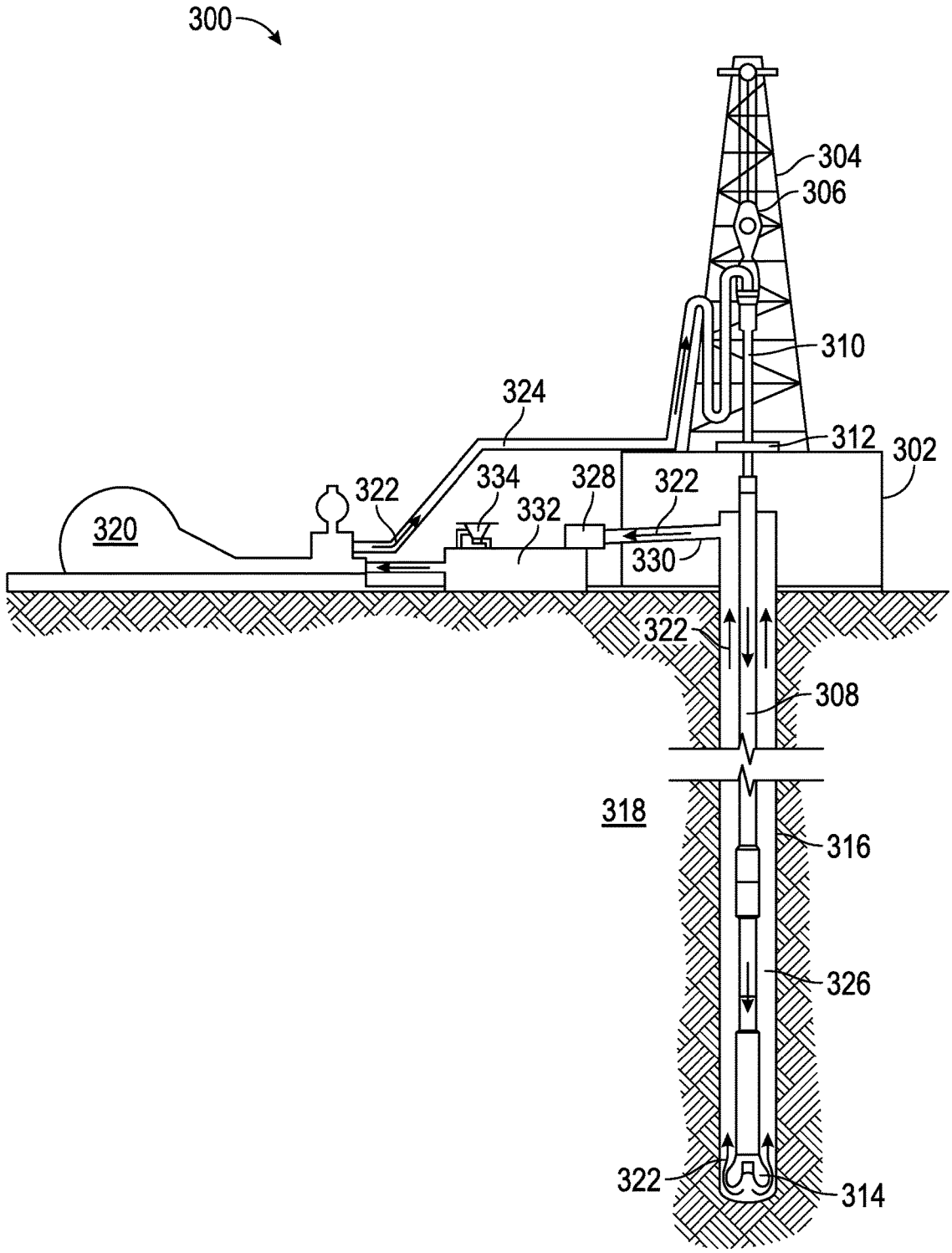
FIG. 3 depicts an embodiment of a system configured for using the micronized barite compositions of the embodiments described herein in a drilling operation.

The exemplary methods disclosed herein may directly or indirectly affect one or more components or pieces of equipment associated with the preparation, delivery, recapture, recycling, reuse, and/or disposal of the disclosed compositions. For example, and with reference to FIG. 3, the disclosed methods may directly or indirectly affect one or more components or pieces of equipment associated with an exemplary wellbore drilling assembly 300, according to one or more embodiments. It should be noted that while FIG. 3 generally depicts a land-based drilling assembly, those skilled in the art will readily recognize that the principles described herein are equally applicable to subsea drilling operations that employ floating or sea-based platforms and rigs without departing from the scope of the disclosure.

As illustrated, the drilling assembly 300 may include a drilling platform 302 that supports a derrick 304 having a traveling block 306 for raising and lowering a drill string 308. The drill string 308 may include, but is not limited to, drill pipe and coiled tubing, as generally known to those skilled in the art. A kelly 310 supports the drill string 308 as it is lowered through a rotary table 312. A drill bit 314 is attached to the lower end of the drill string 308 and is driven either by a downhole motor and/or via rotation of the drill string 308 from the well surface (via top drive or rotary table). As the bit 314 rotates, it creates a is borehole 316 that penetrates various subterranean formations 318.

A pump 320 (e.g., a mud pump) circulates drilling fluid 322 through a feed pipe 324 and to the kelly 310, which conveys the drilling fluid 322 downhole through the interior of the drill string 308 and through one or more orifices in the drill bit 314. The drilling fluid 322 is then circulated back to the surface via an annulus 326 defined between the drill string 308 and the walls of the borehole 316. At the surface, the recirculated or used drilling fluid 322 exits the annulus 326 and may be conveyed to one or more fluid processing unit(s) 328 via an interconnecting flow line 330. After passing through the fluid processing unit(s) 328, a "cleaned" or filtered drilling fluid 322 is deposited into a nearby retention pit 332 (e.g., a mud pit). While illustrated as being arranged at the outlet of the wellbore 316 via the annulus 326, those skilled in the art will readily appreciate that the fluid processing unit(s) 328 may be arranged at any other location in the drilling assembly 300 to facilitate its proper function, without departing from the scope of the scope of the disclosure.

One or more of the disclosed methods may be used to modify the drilling fluid 322 via a mixing hopper 334 communicably coupled to or otherwise in fluid communication with the retention pit 332. The mixing hopper 334 may include, but is not limited to, mixers and related mixing equipment known to those skilled in the art. In other embodiments, however, the disclosed methods may be used to modify the drilling fluid 322 at any other location in the drilling assembly 300. In at least one embodiment, for example, there could be more than one retention pit 332, such as multiple retention pits 332 in series. Moreover, the retention put 332 may be representative of one or more fluid storage facilities and/or units where the compositions may be stored, reconditioned, and/or regulated until added to the drilling fluid 322.

As mentioned above, the methods may directly or indirectly affect the components and equipment of the drilling assembly 300. For example, the disclosed methods may directly or indirectly affect the fluid processing unit(s) 328 which may include, but is not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, any fluid reclamation equipment. The fluid processing unit(s) 328 may further include one or more sensors, gauges, pumps, compressors, and the like used store, monitor, regulate, and/or is recondition the exemplary barite compositions.

The disclosed methods may directly or indirectly affect the pump 320, along with any conduits, pipelines, trucks, tubulars, and/or pipes used to fluidically convey the fluid compositions downhole, any pumps, compressors, or motors (e.g., topside or downhole) used to drive compositions into motion, any valves or related joints used to regulate the pressure or flow rate of the barite compositions, and any sensors (e.g., pressure, temperature, flow rate, etc.), gauges, and/or combinations thereof, and the like. The disclosed methods also directly or indirectly affect the mixing hopper 334, the retention pit 332, and their assorted variations.

The disclosed methods may also directly or indirectly affect the various downhole equipment and tools that may come into contact with the compositions such as, but not limited to, the drill string 308, any floats, drill collars, mud motors, downhole motors and/or pumps associated with the drill string 308, and any MWD/LWD tools and related telemetry equipment, sensors or distributed sensors associated with the drill string 308. The disclosed methods may also directly or indirectly affect any downhole heat exchangers, valves and corresponding actuation devices, tool seals, packers and other wellbore isolation devices or components, and the like associated with the wellbore 316. The disclosed methods may also directly or indirectly affect the drill bit 314, which may include, but is not limited to, roller cone bits, PDC bits, hybrid bits, natural diamond bits, impregnated bits, any hole openers, reamers, coring bits, etc.

While not specifically illustrated herein, the disclosed methods may also directly or indirectly affect any transport or delivery equipment used to convey the compositions to the drilling assembly 300 such as, for example, any transport vessels, conduits, pipelines, trucks, pneumatic conveying systems, tubulars, and/or pipes used to fluidically move the compositions from one location to another, any pumps, compressors, or motors used to drive the barite compositions into motion, any valves or related joints used to regulate the pressure or flow rate of the compositions, and any sensors (e.g., pressure and temperature), gauges, and/or combinations thereof, and the like.

The invention having been generally described, the following examples are given as particular embodiments of the invention and to demonstrate the practice and advantages hereof. It is understood that the examples are given by way of illustration and are not intended to limit the specification or the claims to follow in any manner.

EXPERIMENTS/EXAMPLES

Experiments:

Moisture Sorption Desorption Testing

A sample of CIMBAR UF barite (barium sulfate) was received from Cimbar Performance Products, in Chatsworth, Ga., for testing. Tests were run on the sample at 22° C. (72° F.) to determine sorption/desorption behavior.

Moisture sorption test was conducted on small quantity (in the range of 20-40 mg) of the as received material. The isotherm was performed in 10% RH increments at 22° C. (72° F.), following an initial equilibration at near 0% RH. The experiments were performed using a DVS Moisture Sorption Analyzer from Surface Measurement Systems.

Figure 4A:
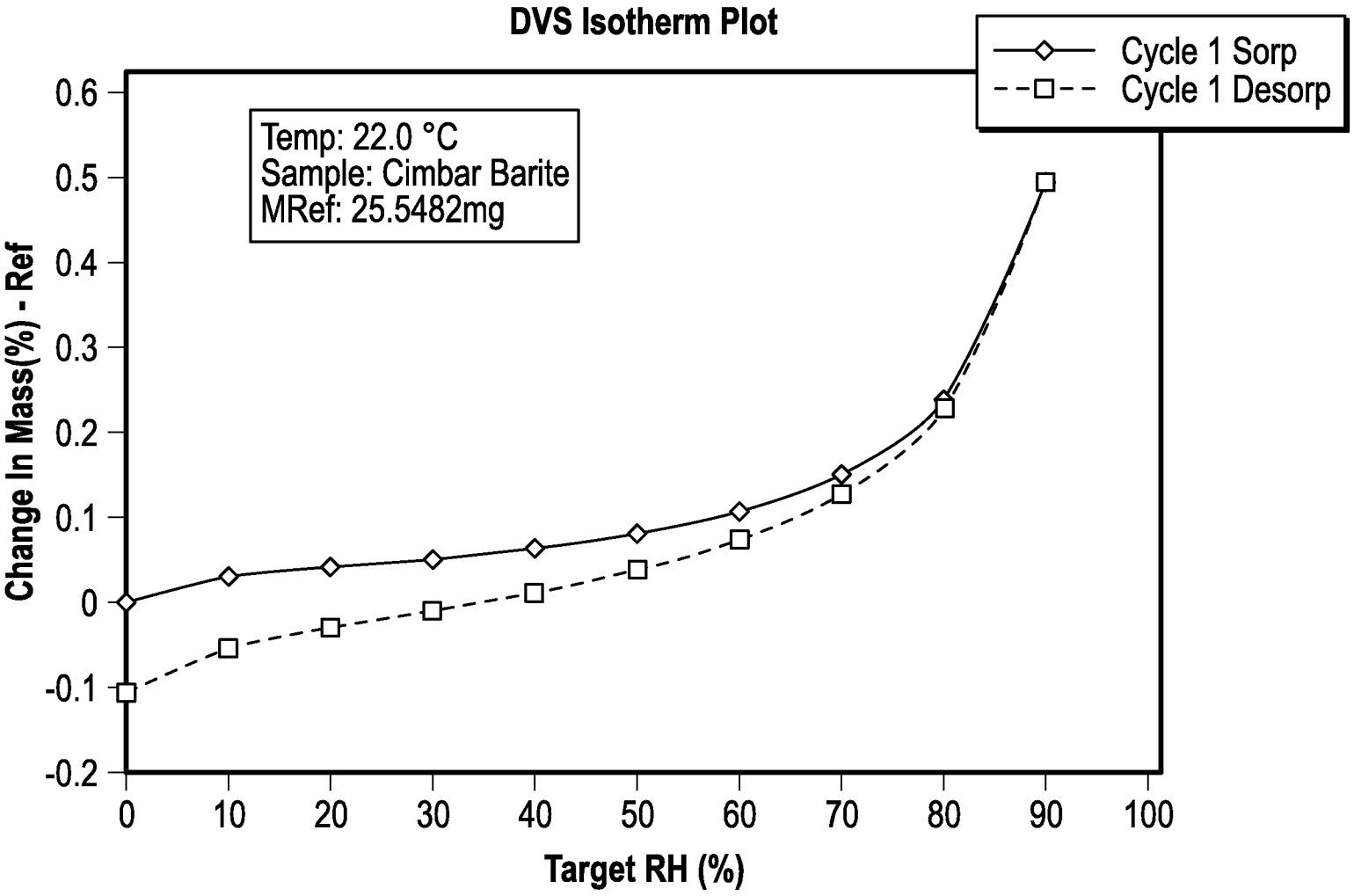
FIG. 4A is an isotherm plot showing Sorption and Desorption behavior of fine barite.
Figure 4B:
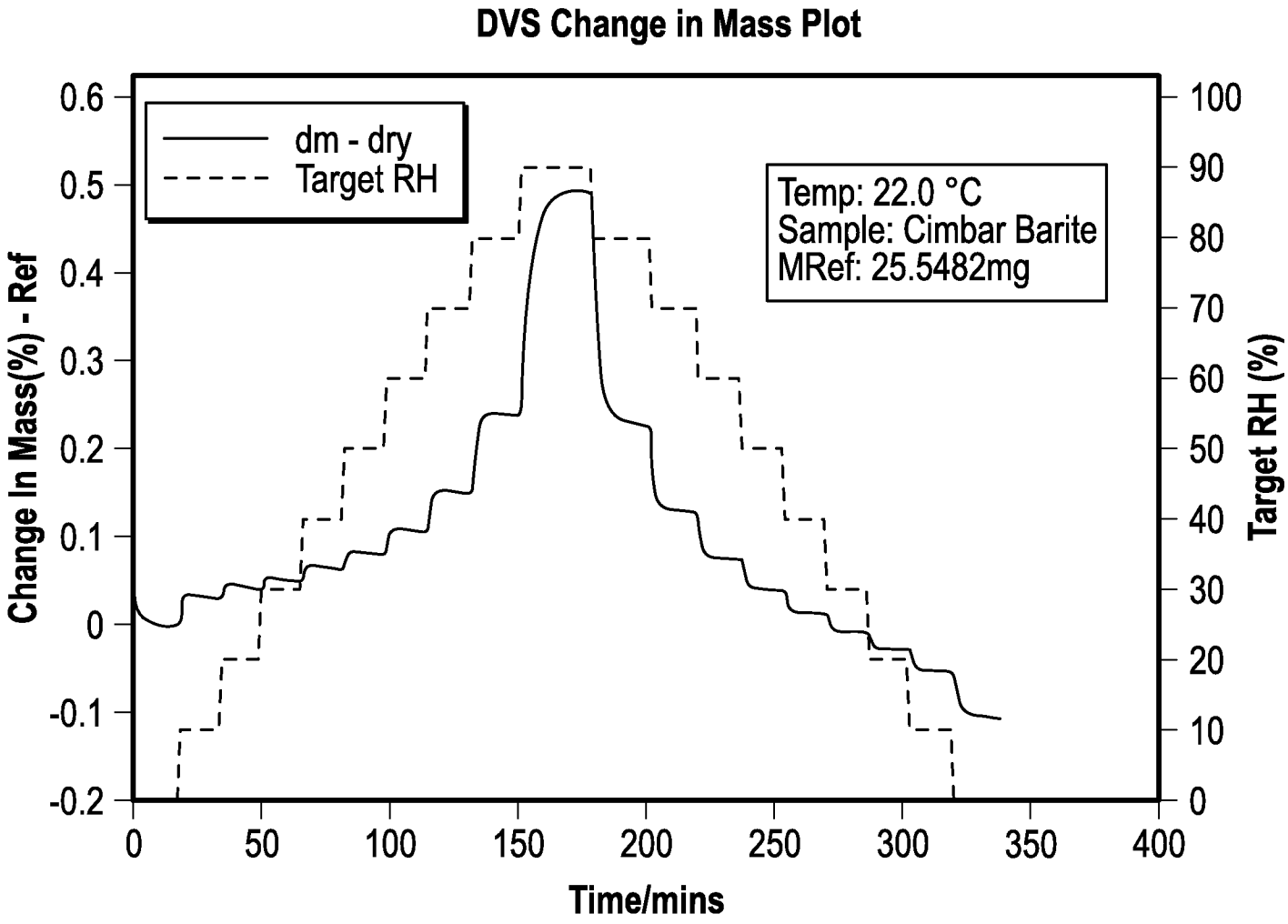
FIG. 4B a plot showing change in mass per unit time of fine barite at a dry condition and various states of relative humidity.

The complete results are provided below, and include a table, Table 1, of equilibrium moisture contents at each RH during the adsorption and desorption test phases, as well as isotherm (FIG. 4A) and change in mass (per unit time) (FIG. 4B) plots.

The as received material reached a dry condition (equilibrated with 0% relative humidity) in about 20 minutes. As relative humidity was increased, in steps of 10%, the material gained moisture. The moisture gain/sorption behavior became pronounced near 60% RH. The sorption behavior was nearly exponential at relative humidity higher than 80%. During desorption test, a similar behavior was noted with a hysteresis/gap between sorption and desorption curves.

TABLE 1

DVS Isotherm Analysis Report
Sample: Cimbar Barite
Temp: 22.0° C.
MRef: 25.5482 from Mass at end of first 0% RH stage
MSt: 25.558 mg starting mass loaded into tester
delM: 0.0 106 mg loss of mass during initial drying stage
AR MC: 0.04149% calculated As Received moisture content

| Target | Change In Mass (%) - ref | | |
|---|---|---|---|
| RH(%) | Sorption | Desorption | Hysteresis |
| 0.0 | 0.0005 | −0.1072 | |
| 10.0 | 0.0294 | −0.0530 | −0.0824 |
| 20.0 | 0.0410 | −0.0283 | −0.0693 |
| 30.0 | 0.0499 | −0.0087 | −0.0586 |
| 40.0 | 0.0630 | 0.0122 | −0.0508 |
| 50.0 | 0.0802 | 0.0385 | −0.0417 |
| 60.0 | 0.1061 | 0.0734 | −0.0327 |
| 70.0 | 0.1501 | 0.1278 | −0.0223 |
| 80.0 | 0.2382 | 0.2275 | −0.0107 |
| 90.0 | 0.4925 | 0.4925 | |

Pneumatic conveying tests using fine, uniform barite, with particle size 2 microns were performed. These fine particles will need to be transferred to drilling rigs using pneumatic conveying. The samples of fine barite are CIMBAR UF™ barite from Cimbar Performance Materials. The biggest concern with the conveying of this material is the tendency of the material to buildup inside the conveying line. Operating characteristics were determined for this material at 35 lb/min and 55 lb/min conveying rates. In addition, an experiment was conducted to see if conveying at higher velocity will help reduce buildup.

Pneumatic Conveying Test

A sample of CIMBAR UF barite (barium sulfate) was received from Cimbar Performance Products for testing. The sample arrived in twenty-four 50 lb bags. Tests were run on the sample at its as received moisture. During the test period, approximate variations of temperature and relative humidity were between 60° F. and 70° F., and between 25% and 50%, respectively.

The following items were evaluated during this testing:

Pneumatic conveying behavior

Operating characteristics at 35 lb/min

Operating characteristics at 55 lb/min

Buildup-reduction study

Description of the Pneumatic Conveying Test System

Figure 5:
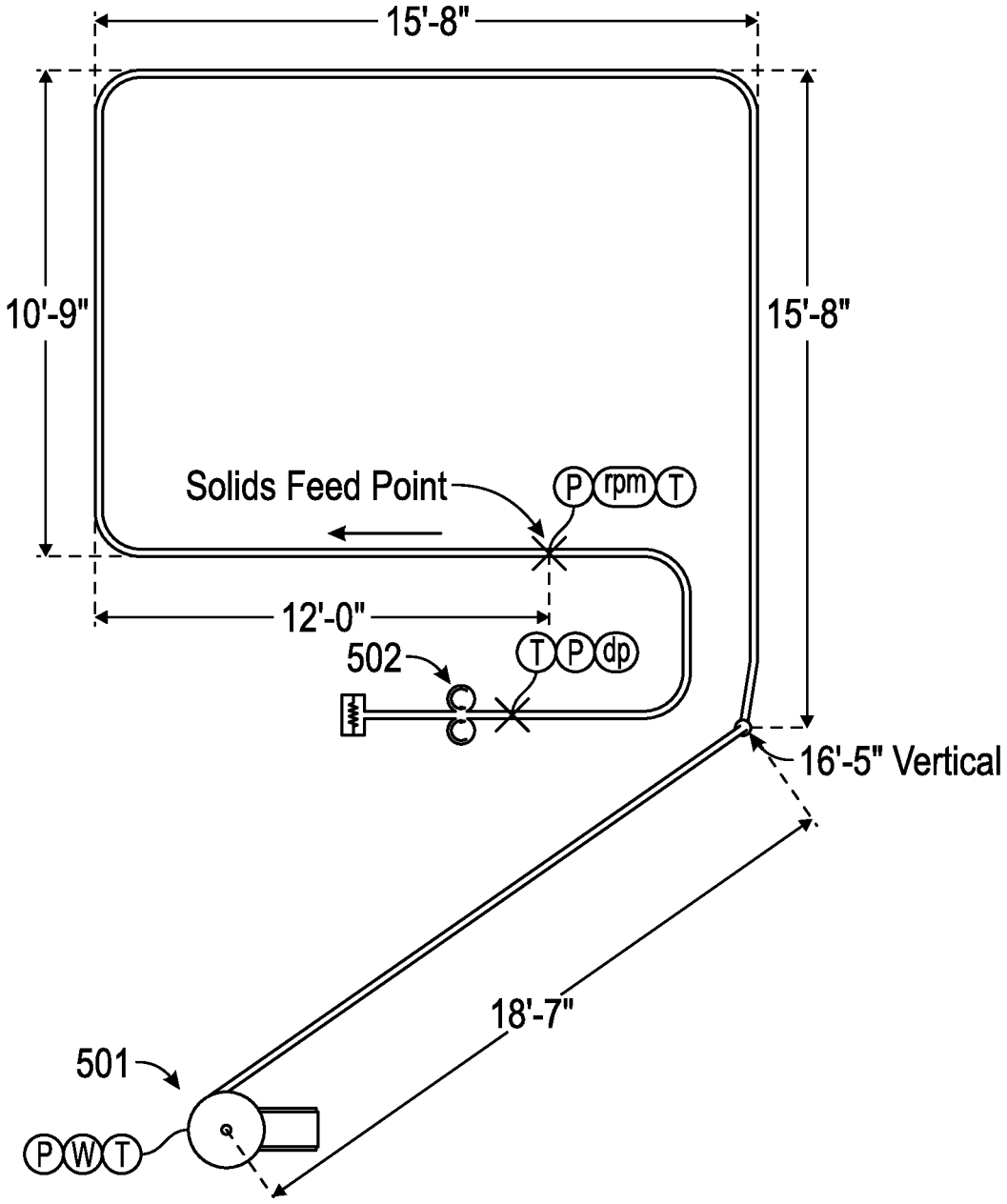
FIG. 5 illustrates the conveying line used for measuring pneumatic conveying parameters.
Figure 6:
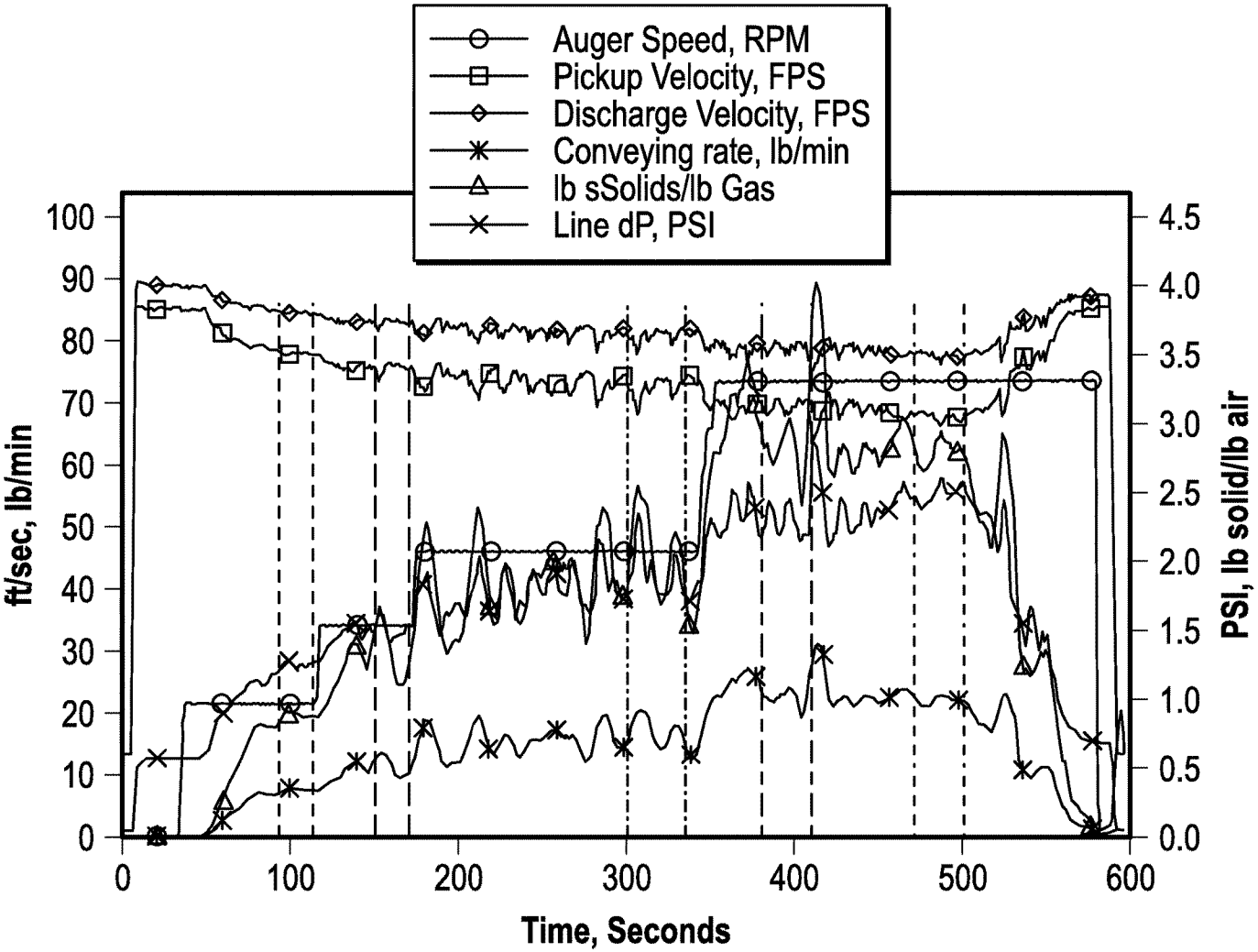
FIGS. 6-12 show logs of the tests and plots of the test data produced in sessions T01-T08.
Figure 7:
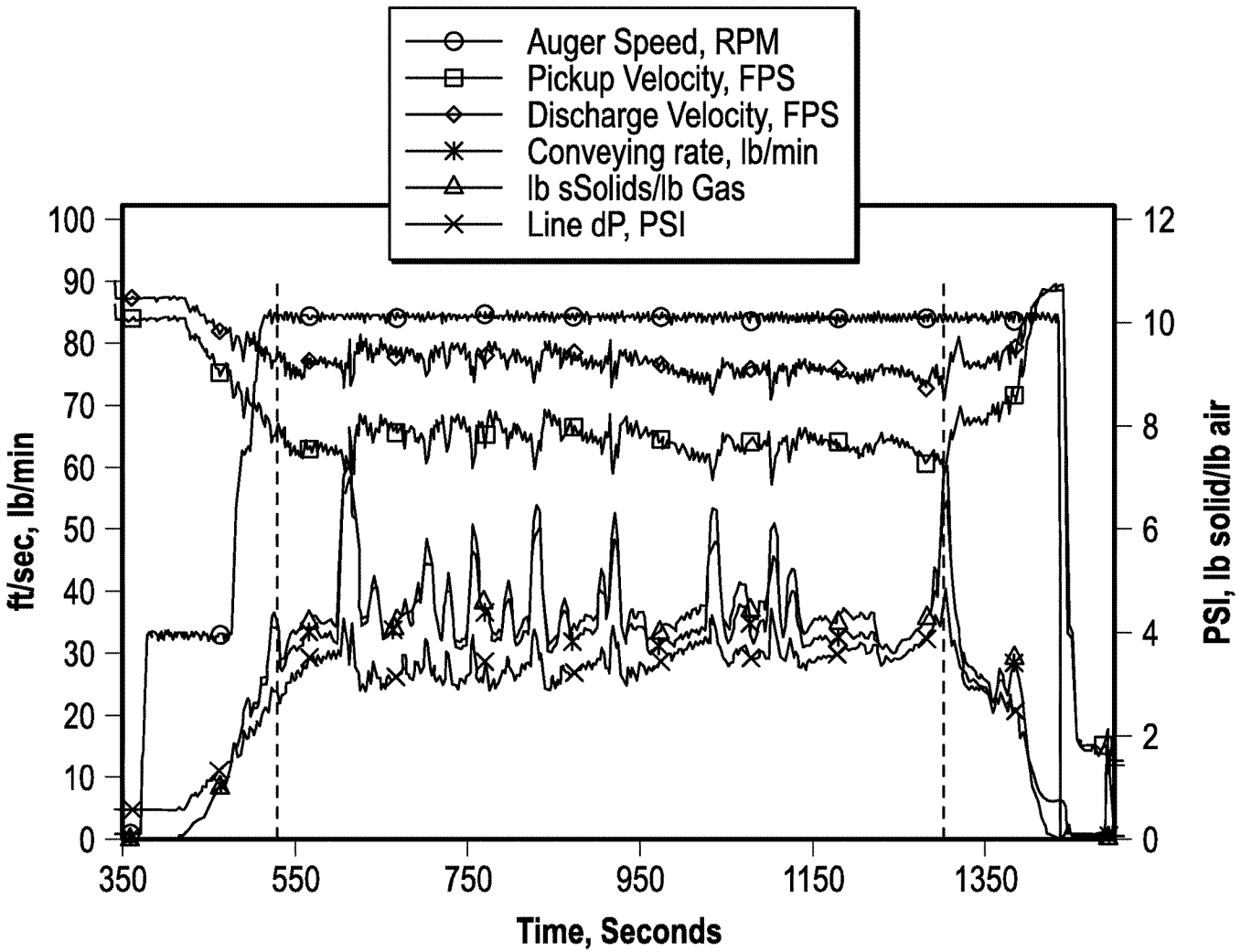
Figure 8:
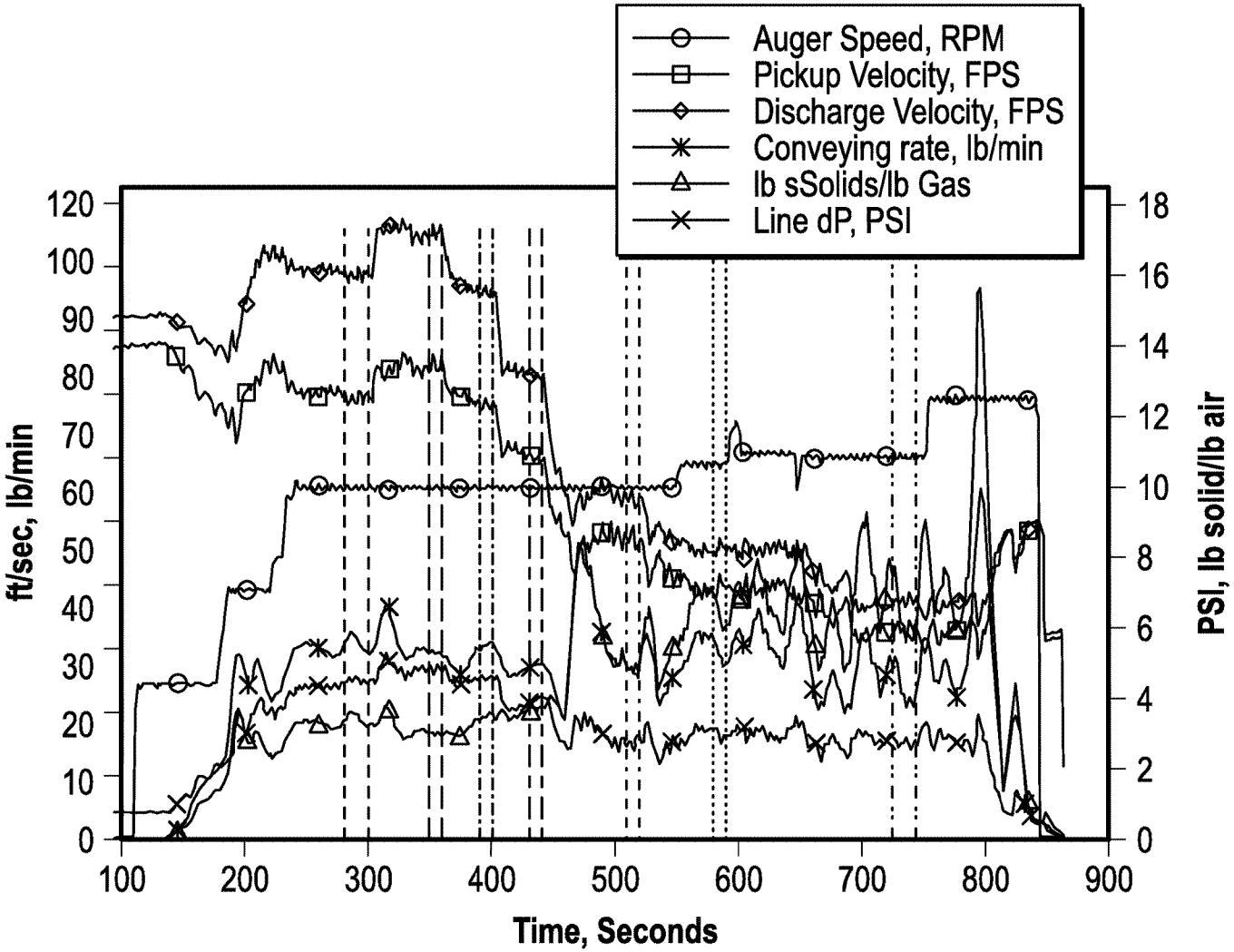
Figure 9:
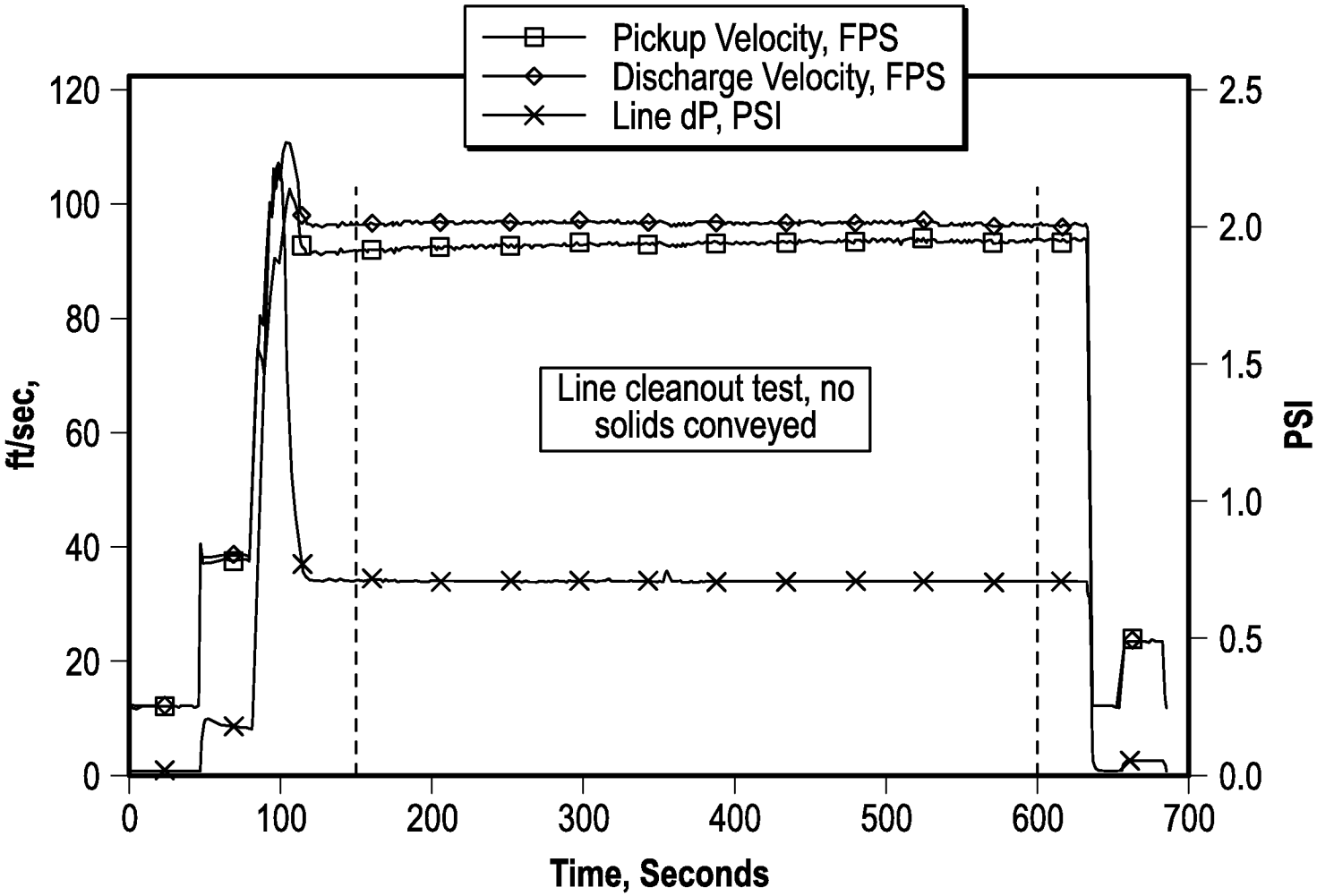
Figure 10:
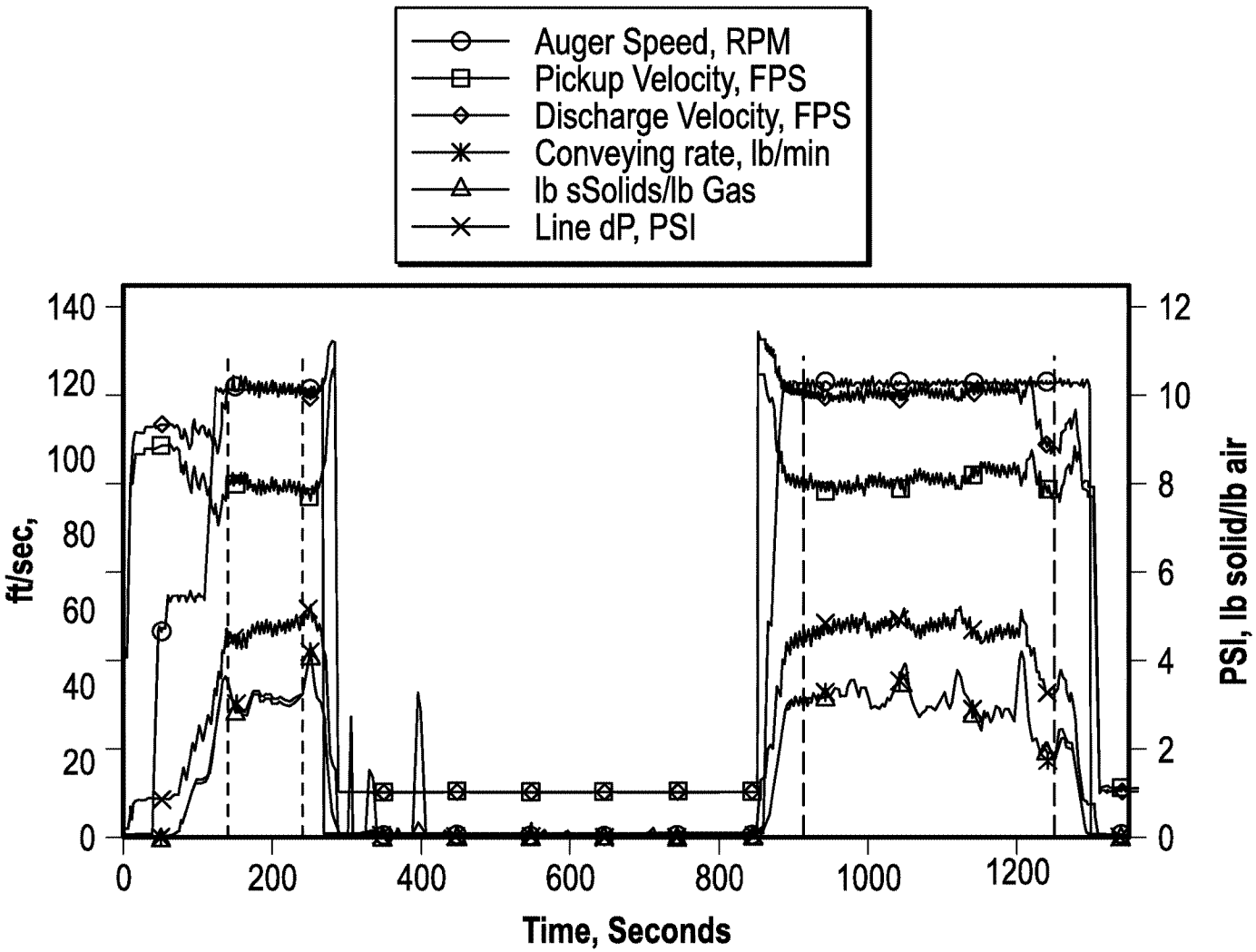
Figure 11:
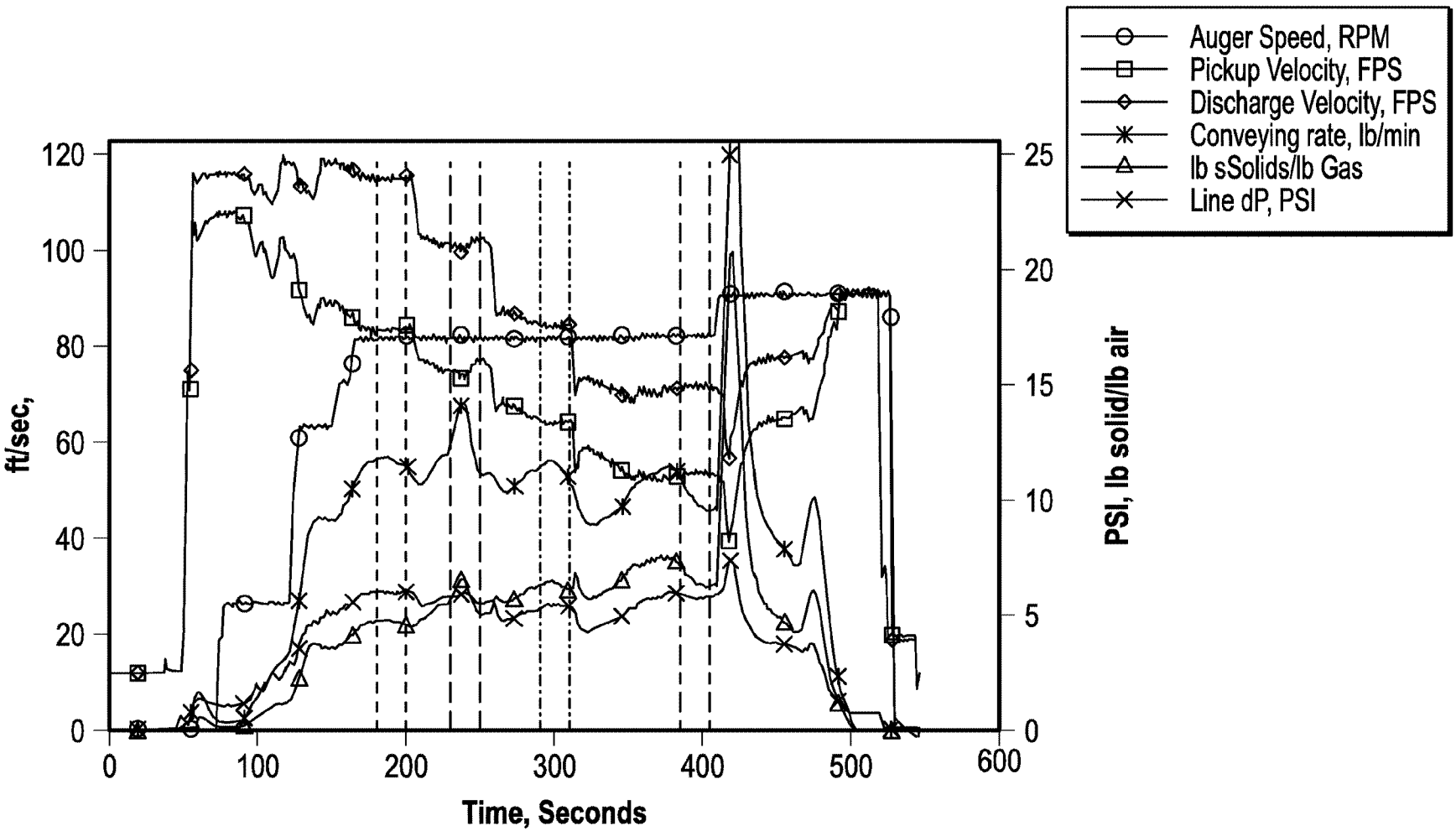
Figure 12:
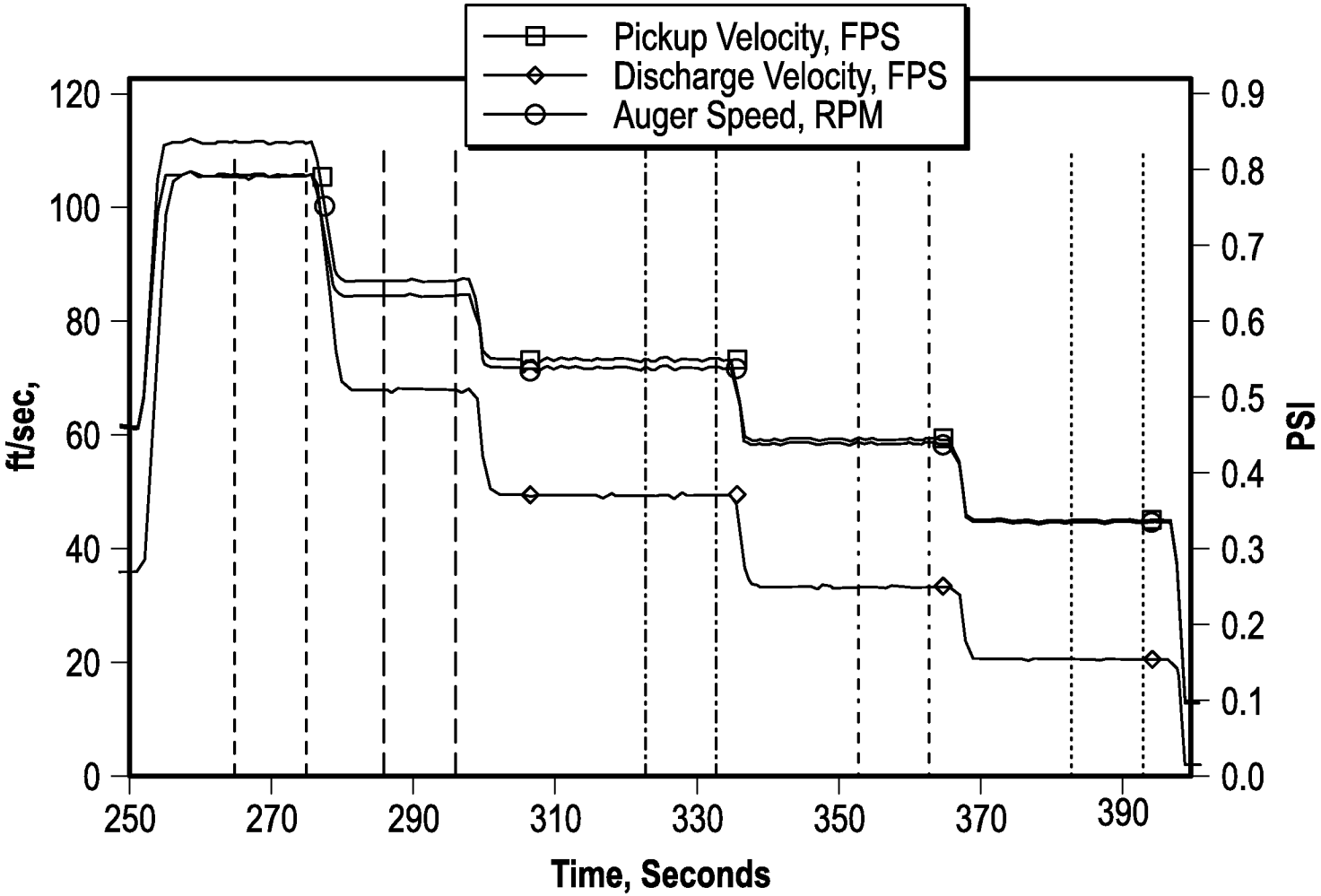

The conveying line used for measuring pneumatic conveying parameters is illustrated in FIG. 5. A lock hopper 501 with a variable speed feed-screw controlled solids feed into a positive-pressure conveying line. A lobed-type blower 502 powered by a variable speed drive controlled the conveying air flow rate. Ambient air was used for conveying, without any dryer. The conveying test loop had 2 inch diameter schedule 40 carbon steel pipeline. The conveying line length was approximately 90 ft. The line configuration included five 90° elbows.

Data from a pitot tube station at the blower discharge was used to calculate air-flow rates. Load cells under the receiving hopper measured the weight of material conveyed. A data acquisition system captured pitot tube data, line pickup pressure, pickup air temperature, receiver temperature and pressure, receiving hopper weight, feed-screw rpm, and ambient relative humidity. The raw data was imported into a spreadsheet program, where velocities and phase densities were calculated and a plot of test parameters was generated.

Each data acquisition session was given a unique number for identification (from T01 to T08). A log of the tests and plots of the test data produced in these sessions are provided as FIGS. 6-12.

Pneumatic Conveying Test Results

Pneumatic Conveying Behavior

The pneumatic conveying of barite was assessed both qualitatively and quantitatively.

Behavior in the Pneumatic Conveying Line

The tests ran showed that fine barite conveyed without any pluggage issues in a dilute phase pneumatic conveying mode, at various air velocities. However, it must be kept in mind that the run-times in our tests were short, as shown in the test-data provided in the plots at the end of this report.

Figure 13:
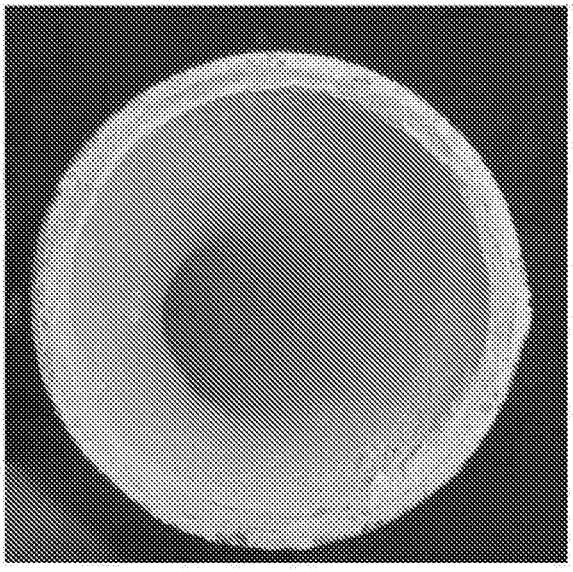
FIG. 13 shows a typical example of material buildup inside an elbow.

Line buildup is of primary concern for this material. It was observed during these tests that fine barite has a tendency to form a material buildup layer inside the conveying line. Note that even in short run-times, buildup behavior was noticed. Often times in a conveying line, elbows are the worst places from a material buildup perspective. After a typical test-run, elbows were removed and inspected for buildup. FIG. 13 shows a typical example of material buildup inside an elbow. The material also very quickly coated a clear/transparent section of our pneumatic conveying test loop.

Note that over time, buildup can grow and decrease the conveying line size. This can affect the conveying rate, and may eventually cause plugging of the line.

Figure 14:
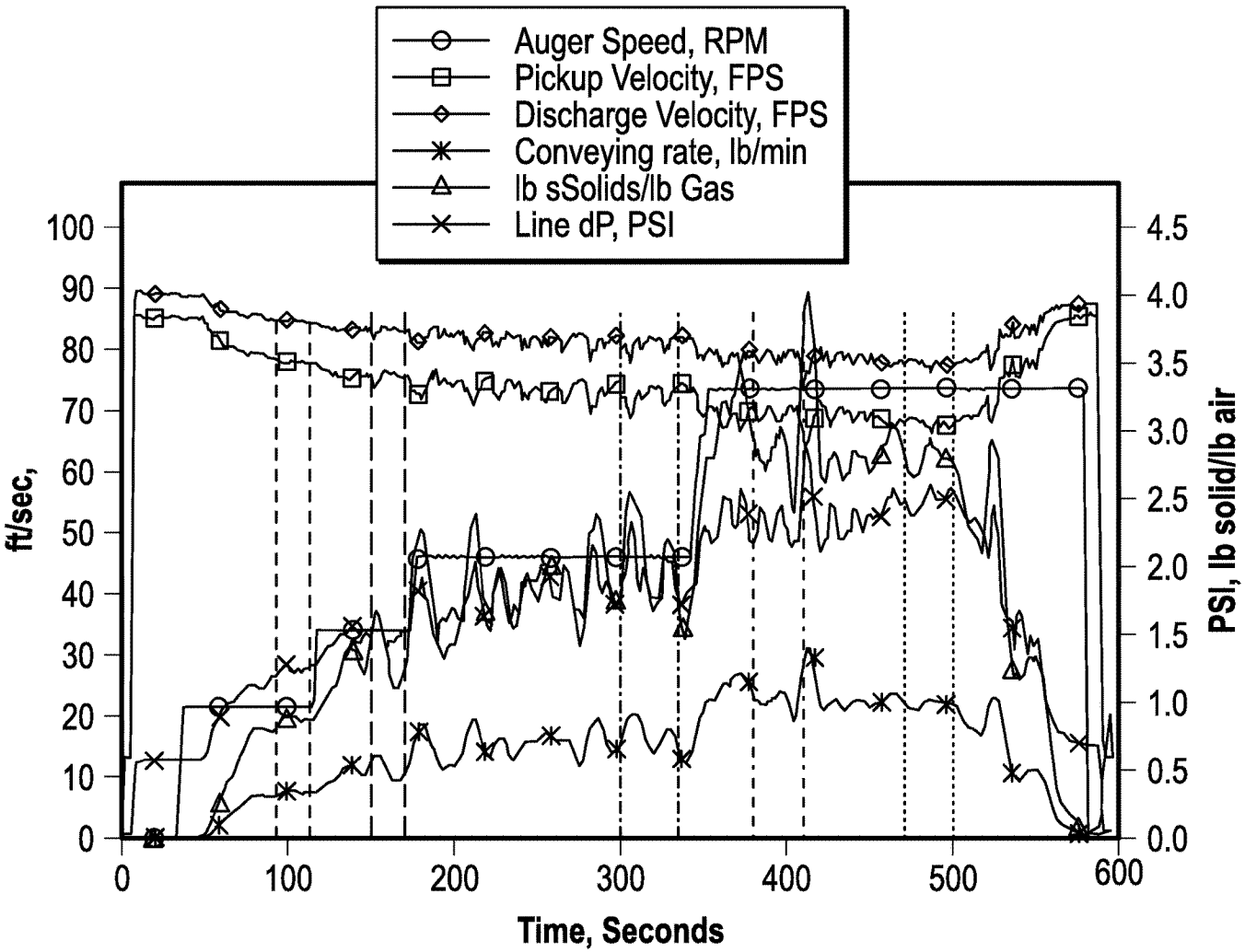
FIG. 14 shows an example of quantitative characterization of the pneumatic conveying behavior.

FIG. 14 shows an example of quantitative characterization of the pneumatic conveying behavior. This quantitative characterization captured air-velocity at the pickup point of solids, air-velocity at the discharge point, solids conveying rate, pressure losses in the line, and solids-loading-ratio/phase density (lb solids/lb gas) among many other things. This data was captured continuously, as a function of time, while the tests were running.

Plots T01 to T08 provide further quantitative insight into the pneumatic conveying behavior in our test loop.

The absolute performance data presented here is specific to the test-loop/system. The trends and minimum velocity data can be applied to other systems when scaled properly.

Getting the Material into the Pneumatic Conveying Line

The impermeability and aeration-retention of CIMBAR UF™ (fine barite) made it difficult to feed it into the pneumatic conveying line at a controlled rate in the test setup. It is likely that fine barite was too frictional to discharge in a mass-flow condition from the feed hopper in our test loop. It appears that the material was channeling through the hopper. This channeling behavior resulted in discharge rate variations from the feed hopper.

Operating Characteristics at 35 lb/min

Pneumatic conveying tests were run to determine operating characteristics for conveying fine barite at 35 lb/min in our 2 inch diameter line. Variation of pressure drop in the line was plotted against the air velocity at the solids pickup point. This plot is presented in FIG. 15. The curve takes into account adjustments to the measured pressure drops due to variations in the conveying rates around the target rate of 35 lb/min.

Figure 15:
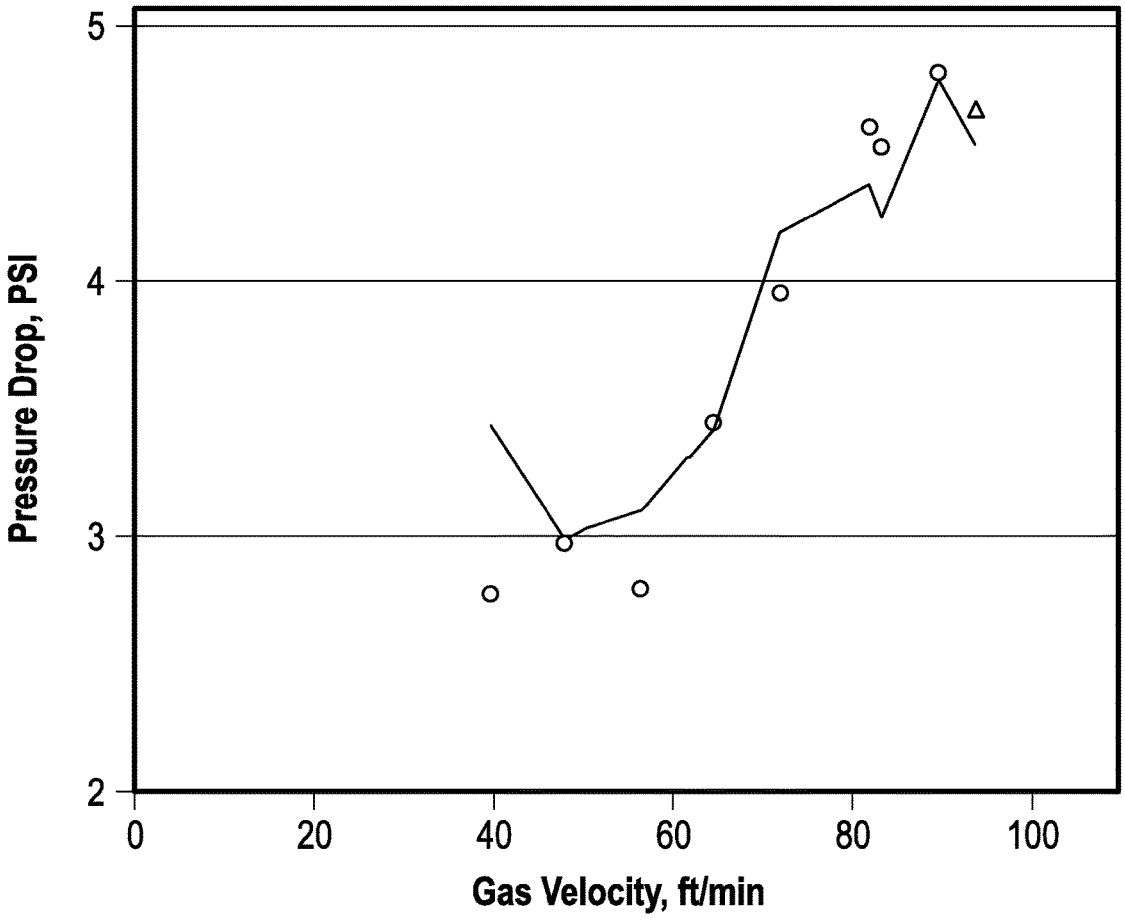
FIG. 15 shows the variation of pressure drop in a line plotted against the air velocity at the solids pickup point at 35 lb/min.

As shown in FIG. 15, a clear trough is seen at low velocity where the pressure drop reaches a minimum and then increases as the gas velocity is reduced. The low point of the trough is the most efficient conveying condition since it represents the lowest pressure drop required to convey a given rate.

The terminal point of the curve to the left of the trough is determined when the conveying rate begins to drop off at a constant feed screw speed. For many materials this would indicate that line pluggage is imminent. For fine barite sample we tested, it may indicate buildup is occurring, decreasing the active line diameter and increasing pressure drop.

Operating Characteristics at 55 lb/min

Pneumatic conveying tests were run to determine operating characteristics for conveying fine barite at 55 lb/min in our 2 inch diameter line. Variation of pressure drop in the line was plotted against the air velocity at the solids pickup point. This plot is presented in FIG. 16. The curve takes into account adjustments to the measured pressure drops due to variations in the conveying rates around the target rate of 55 lb/min.

Figure 16:
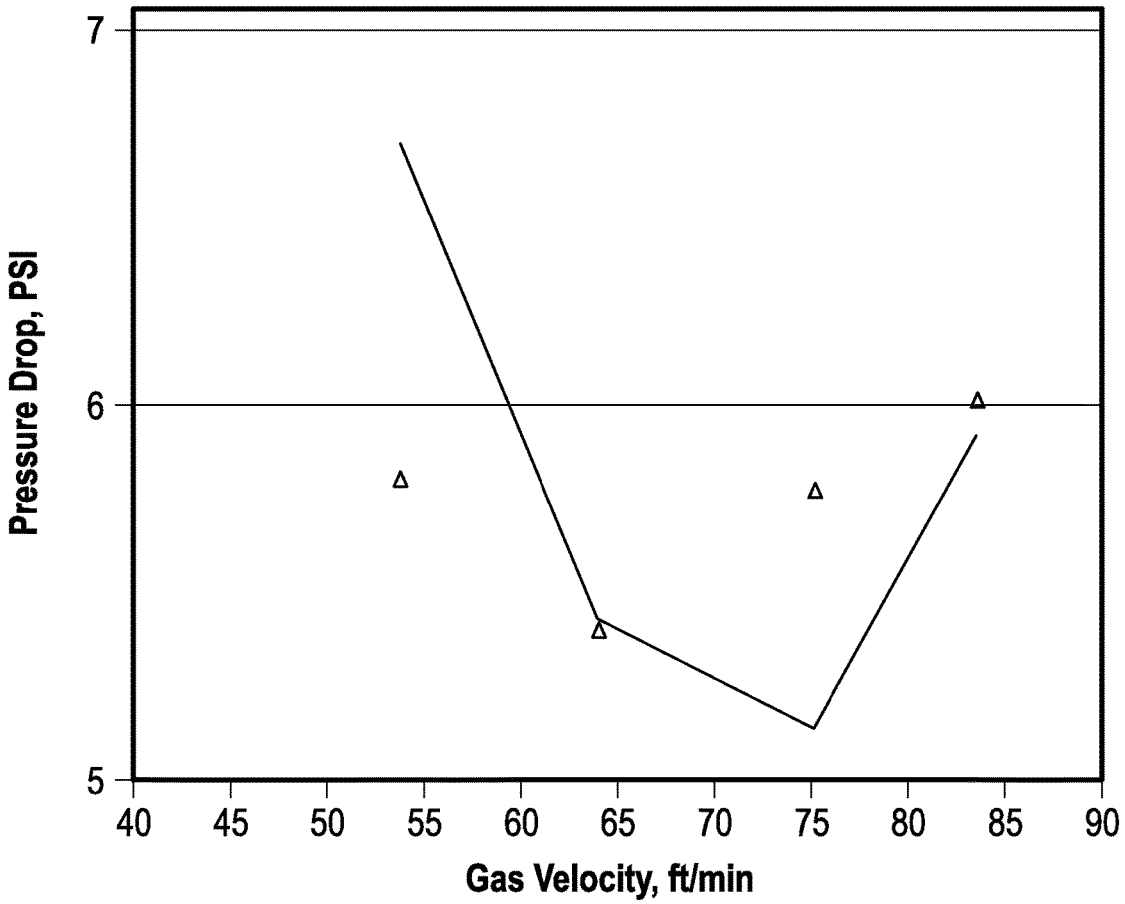
FIG. 16 shows the variation of pressure drop in a line plotted against the air velocity at the solids pickup point at 55 lb/min.

As seen in FIG. 16, a trough where the pressure drop reaches a minimum is the most efficient conveying condition since it represents the lowest pressure drop required to convey a given rate.

Buildup-reduction Study

Line buildup is of primary concern for this material. It was observed during these tests that fine barite has a tendency to form a material buildup layer inside the conveying line.

Figure 17A:
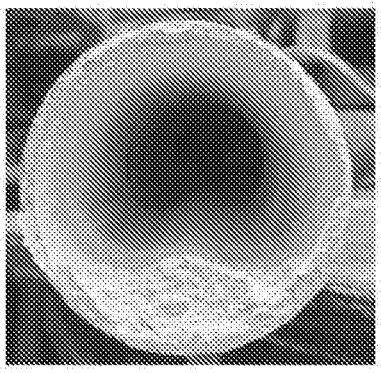
FIGS. 17A and B show a comparison of the buildup in elbow number 1 after two different runs.

The next test was run to see if buildup in the line depended on conveying velocity. If true, higher conveying velocity will help reduce buildup. To that end, a pneumatic conveying test was run at about 40 ft/min air velocity at the solids pick up point. After the test, elbows were carefully removed, creating minimal disturbance to the buildup, and buildup was observed. Then the elbows were connected again, carefully. Then, another pneumatic test was run at a high air velocity of about 90 ft/min at the solids pick up point. Again elbows were carefully removed and buildup was observed. FIGS. 17A,B shows comparison of the buildup in the same elbow, elbow #1, after these two runs.

Figure 17B:
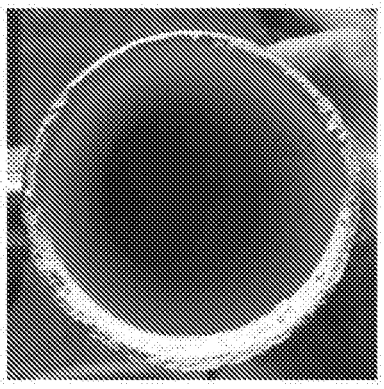

As you can see from FIG. 17B, this testing indicates that buildup in the line can reduce when barite is conveyed at high air velocities. Some of the material in the elbow at lower conveying velocity, as seen in FIG. 17A, can be a consequence of settling/saltation.

Figure 18:
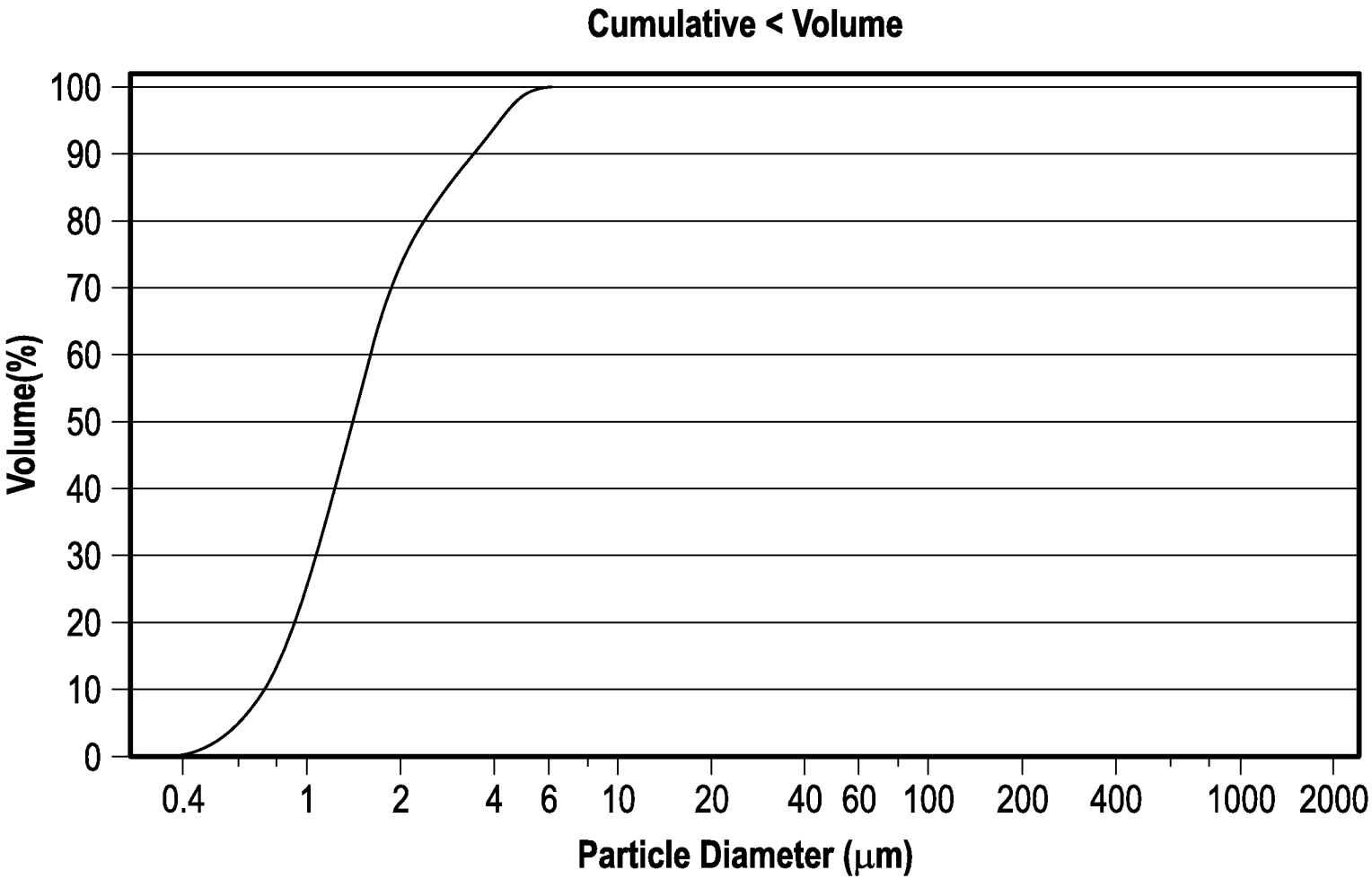
FIGS. 18-20 show the particles size distributions for CIMBAR EX™, CIMBAR UF™, and CIMBAR XFT™.
Figure 19:
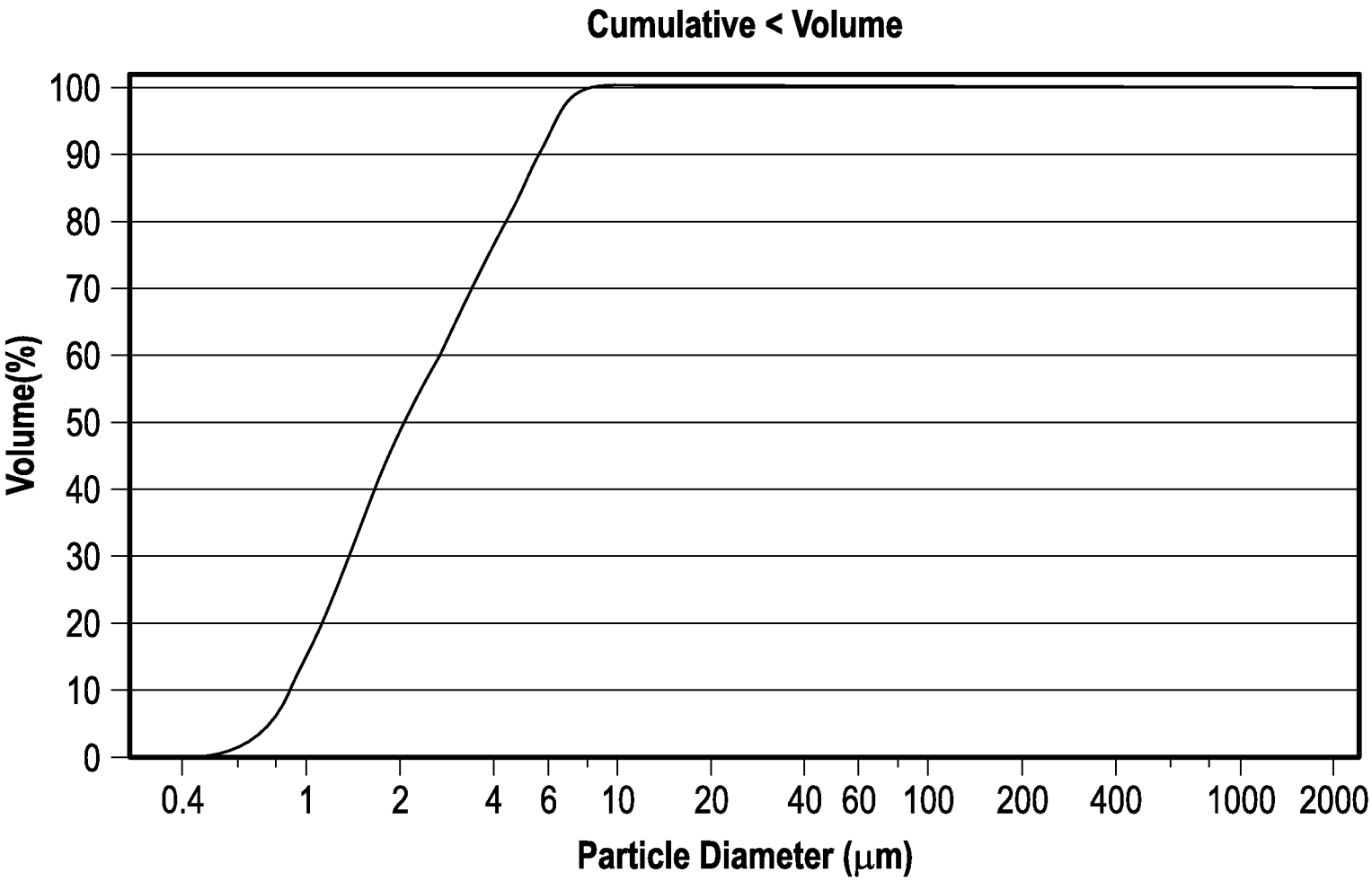
Figure 20:
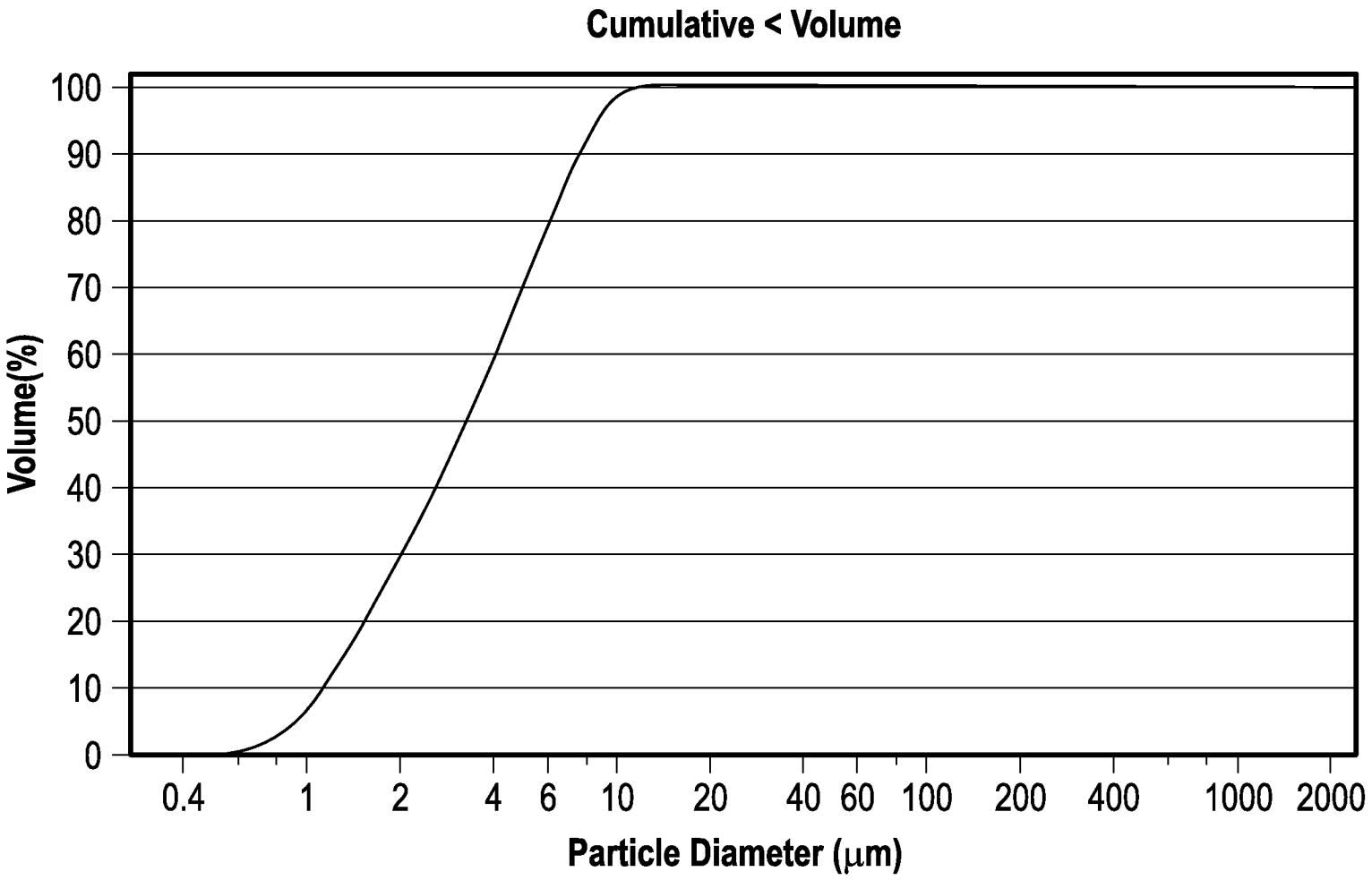

The particles size distributions for CIMBAR EX™, CIMBAR UF™, and CIMBAR XF™ are shown in FIGS. 18-20 respectively.

Conveying Field Tests for 2 Micron Barite

Figure 21:
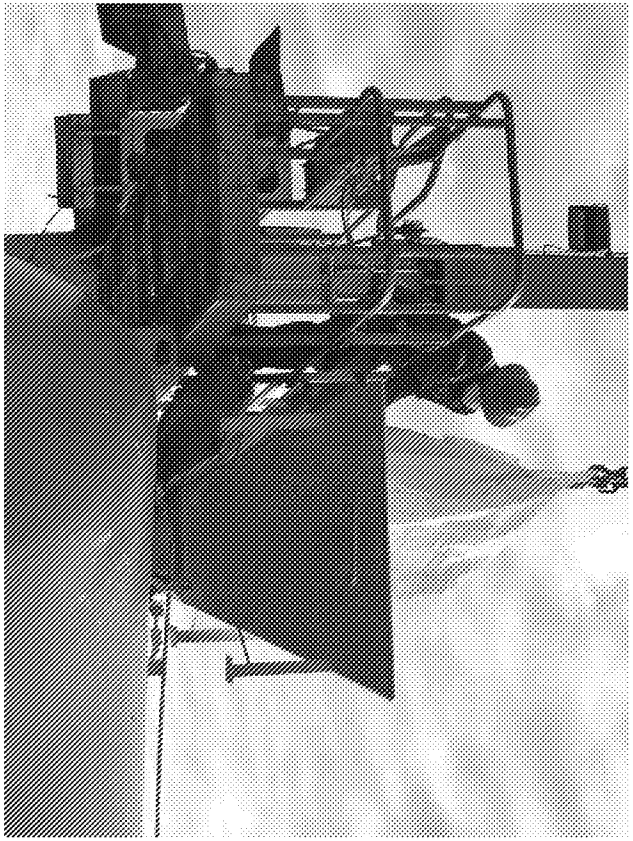
FIGS. 21-25 show photographs of the tanks containing bulk barite in conveying field tests.
Figure 22:
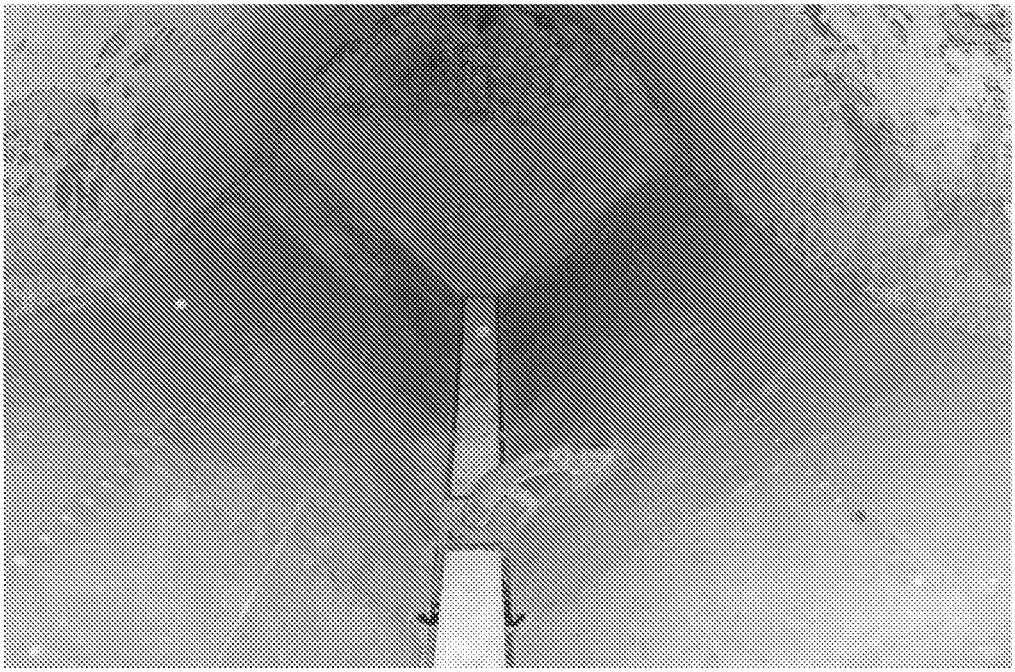
Figure 23A:
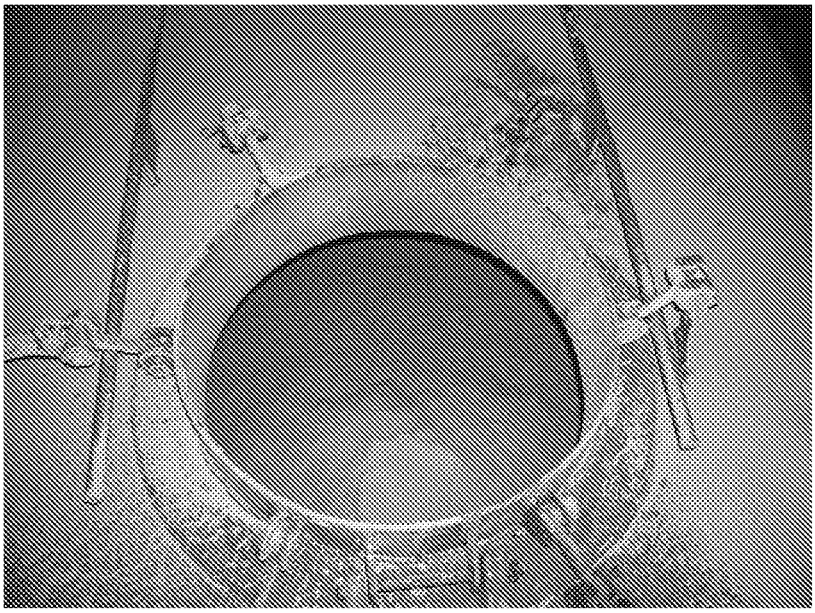
Figure 23B:
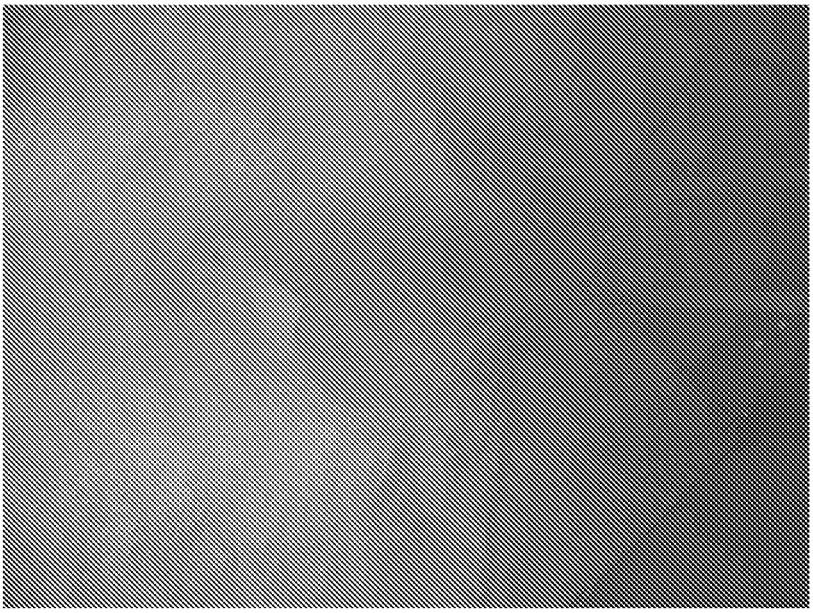
Figure 24A:
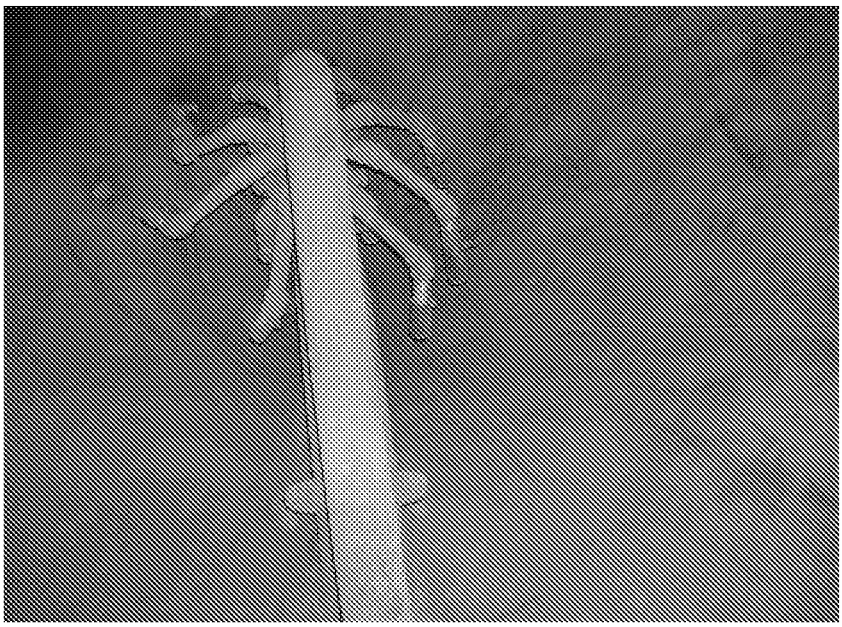
Figure 24B:
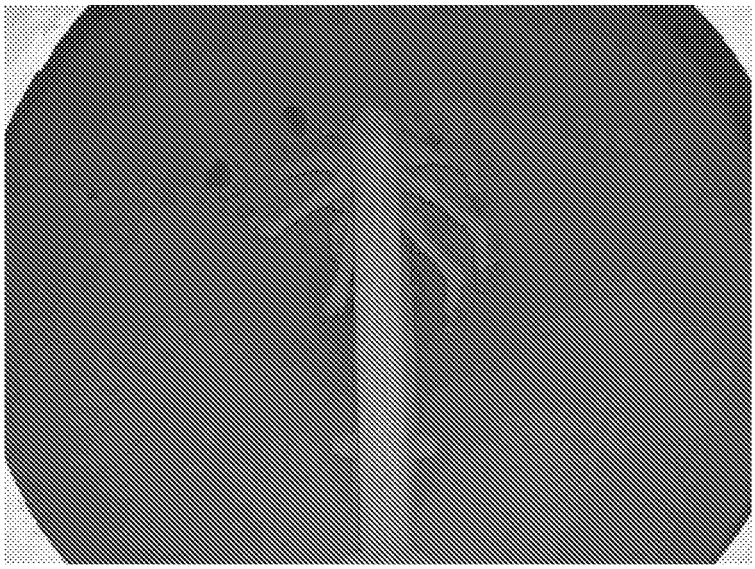
Figure 25:
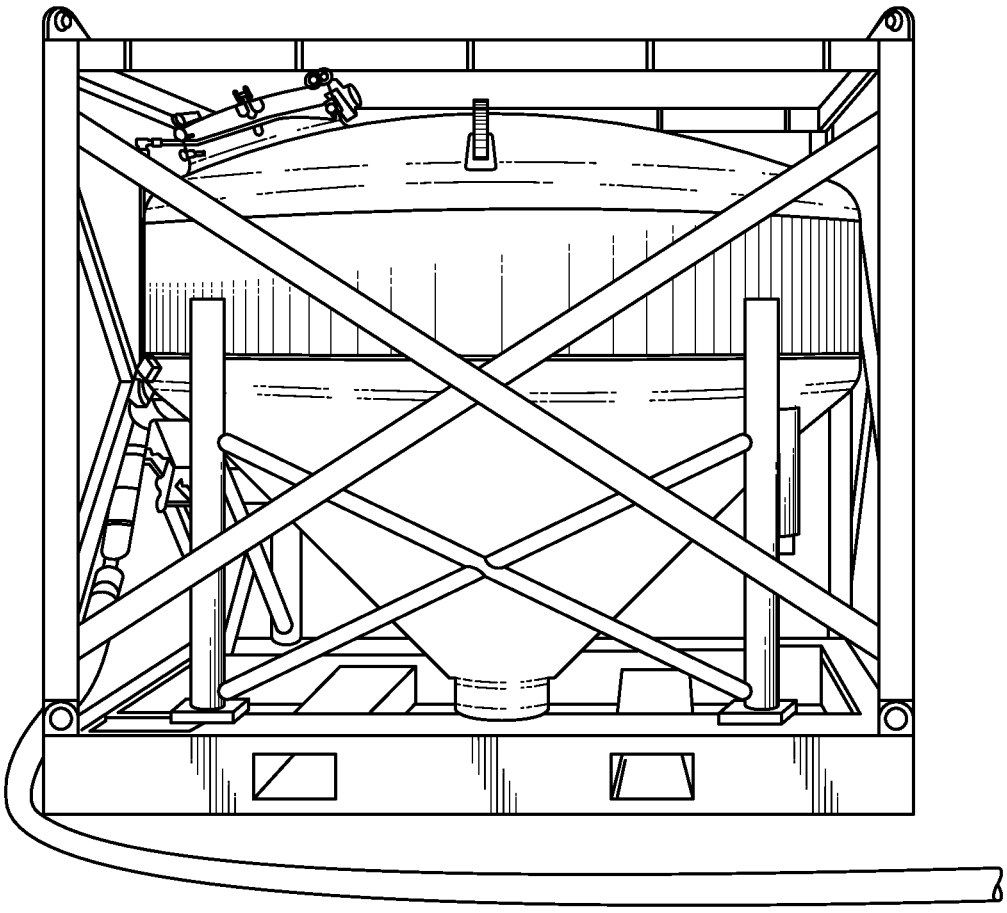

FIGS. 21-25 show photographs of bulk barite conveying field tests using horizontal and vertical vessels. FIG. 21 illustrates a procedure for loading bulk barite bags into a tank by holding the bags with a crane and cutting them into the tank. A horizontal tank slide is shown in FIG. 22. FIG. 23A shows how full the horizontal tank was after cutting in 19 one ton bags of bulk barite. FIG. 23B shows the remaining barite, two to three bags, in the horizontal tank after the conveying test that did not convey. FIG. 24A shows a vertical cement tank before conveying barite into the tank, and as shown in FIG. 24B, after conveying the barite out of the tank. FIG. 25 shows the vertical cement tank used in the tests.

To perform one of the tests, 19 big bags of 2 micron barite were cut into horizontal tank "A". The contents transferred to horizontal tank "B" with 25 to 30 PSI and 100 feet of hose. Additionally 12 tons were transferred from tank B to a vertical "cement" tank with same pressure and hose. The contents in the vertical cement tank were then transferred back to horizontal tank B. The vertical cement tank was pumped mostly empty using the same pressure and hose.

Next, the barite in horizontal tank B was transferred back to the vertical cement tank using the same pressure and hose. The barite was then transferred back to tank B with a transfer rate of 36 short tons per hour. The vertical cement tank was left essentially empty. Even though the transfer rate similar for both types tanks but the vertical cement tank empties more completely.

Next, the barite material was left static in tank B for three days. The bulk barite was then transferred to a bulk truck for transport. Twice, the barite material caked on the inside of horizontal tank B to the point where the hatch had to be opened, and the material swept off of the tank walls. The total time to load the truck (including sweeping down) was 5 to 6 hours and approximately 4 to 5 big bags of barite material were left in the tanks.

The tests show that the product appears to cake/coat the lines and tanks and that build up over time may be an issue. Also, the bulk barite pumps better from the vertical cement tank with spider aeration versus the horizontal tanks with air slides. Transfer rates are slow at approximately 36 tons/hr. Blow-by dust to the dust collector was 40-50 pounds. Further, it may be difficult to get from the tank to the bulk truck.

Transfer of 2 Micron Barite from Bulk Truck to Bulk Tank

Continuing with the barite in tank B mentioned above, a bulk truck was loaded with 2 micro barite that had been left static for three days in the tank. After sitting in the truck overnight and being transported to a storage facility, the bulk truck was unloaded using pneumatic conveyance. The truck driver noted that the barite transfer was slow due to some caking after 1 hour, and a rubber hammer was used to impact the tank and allow the remainder of the 2 micron barite to be moved. The total transfer time was 1-½ hours for 12.68 tons of bulk barite. The loss of 6.32 tons was exclusively due to losses in transfer from the horizontal tank B at the test location. That volume of barite remains in the horizontal tanks at the test site.

The results show that 2 micron barite can be transferred by pneumatic means albeit slower than standard barite—36 tons/hour in the test vs. 100 tons/hour standard rate. Caking was noted and may be directly related to moisture added by the pressurized air system. Barite that had sat in the tank after transfer exhibited caking while the initial transfer of "dry" barite exhibited less caking.

Embodiments disclosed herein include:

A: An apparatus comprising a superstructure including: a cylindrical vessel with a conical bottom section and an opening near the base of the cone; an air assisted puffer device inside the cylindrical vessel near the base of the cone; an air blower with an inlet and an outlet, said air blower attached to the superstructure adjacent the opening of the cone, wherein the inlet of the air blower is in fluid communication with the opening near the base of the cone and the air blower is configured to produce air velocities of at least about 40 ft/min; a gently sweeping elbow in fluid communication with the blower outlet and attached downstream of the air blower outlet; and a hatch fitted to the top of the vessel allowing bulk barite powder to be loaded into the top of the tank from bulk bags.

B: A method of conveying bulk barite comprising: loading bulk barite into an apparatus, wherein the bulk barite comprises particles at least about 1 micron in size at D50 distribution up to about 6 microns in size at D50 distribution, said apparatus comprising a superstructure: a cylindrical vessel with a conical bottom section and an opening near the base of the cone; an air assisted puffer device inside the cylindrical vessel near the base of the cone; an air blower with an inlet and an outlet, said air blower attached to the superstructure adjacent the opening of the cone, wherein the inlet of the air blower is in fluid communication with the opening near the base of the cone and the air blower is configured to produce air velocities of at least about 40 ft/min; a gently sweeping elbow in fluid communication with the blower outlet and attached downstream of the air blower outlet; and a hatch fitted to the top of the vessel thereby allowing bulk barite to be loaded into the top of the tank from bulk bags cut into the funnel; and conveying the bulk barite through the elbow.

C: A barite powder blend comprising: a blend of barite particles with a size of about 1 micron and barite particles with a size of at least about 325 mesh, wherein the D50 of the blend is not greater than about 325 mesh.

D: A well treatment system comprising: a well treatment apparatus comprising a superstructure including a conveying system configured to pneumatically convey bulk barite including: a cylindrical vessel with a conical bottom section and an opening near the base of the cone; an air blower with an inlet and an outlet, said air blower attached to the superstructure adjacent the opening of the cone, wherein the inlet of the air blower is in fluid communication with the opening near the base of the cone and the air blower is configured to produce air velocities of at least about 40 ft/min; an air assisted puffer device inside the cylindrical vessel near the base of the cone; a gently sweeping elbow of about 15 degrees to about 90 degrees in fluid communication with the blower outlet and attached downstream of the air blower outlet; and a hatch fitted to the top of the vessel that allows for a removable funnel shaped hopper to be connected to the tank thereby allowing bulk barite to be loaded into the top of the tank from bulk bags, wherein the bulk barite comprises particles at least about 1 micron in size at D50 distribution up to about 6 microns in size at D50 distribution.

Each of embodiments A, B, C and D may have one or more of the following additional elements in any combination: Element 1: wherein the conical bottom has sides at an angle in the range of about 30 degrees to about 60 degrees to the horizontal. Element 2: wherein the angle is about 50 degrees. Element 3: wherein the blower air velocity is in the range of about 55 ft/min to about 95 ft/min. Element 4: further comprising a diverter valve with an inlet and at least one outlet, wherein the inlet is in fluid communication with the opening of the cone and the at least one outlet is in fluid communication with the inlet of the air blower, configured to allow the blower to be operated to vent without loss or movement of barite powder if the tank is being loaded. Element 5: further comprising a hose connection in the upper section configured to allow for loading powder from another tank of similar design. Element 6: wherein the gently sweeping elbow has an angle of about 15 degrees to about 90 degrees. Element 7: further comprising a power system to operate the blower. Element 8: further comprising a removable funnel shaped hopper, wherein the hatch fitted to the top of the vessel allows for a removable funnel shaped hopper to be connected to the tank. Element 9: wherein the bulk barite particles are a blend of barite particles with a size of about 1 micron and barite particles with a size of at least about 325 mesh, wherein the D50 of the blend is not greater than about 325 mesh.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

The invention claimed is:

1. A method of conveying bulk barite comprising:

loading bulk barite into an apparatus, wherein the bulk barite comprises particles at least about 1 micron in size at D50 distribution up to about 6 microns in size at D50 distribution, said apparatus comprising a superstructure including:

a cylindrical vessel with a conical bottom section and an opening near the base of the cone;

an air assisted puffer device inside the cylindrical vessel near the base of the cone;

an air blower with an inlet and an outlet, said air blower attached to the superstructure adjacent the opening of the cone, wherein the inlet of the air blower is in fluid communication with the opening near the base of the cone and the air blower is configured to produce air velocities of at least about 40 ft/min;

a gently sweeping elbow in fluid communication with the blower outlet and attached downstream of the air blower outlet; and a hatch fitted to the top of the vessel thereby allowing bulk barite to be loaded into the top of the vessel from bulk bags; and conveying the bulk barite through the elbow.

2. The method of claim 1, wherein the conical bottom has sides at an angle in the range of about 30 degrees to about 60 degrees to the horizontal.

3. The method of claim 2, wherein the angle is about 50 degrees.

4. The method of claim 1, wherein the blower air velocity is in the range of about 55 ft/min to about 95 ft/min.

5. The method of claim 1, further comprising a diverter valve at the base of the vessel, configured to allow the blower to be operated to vent without loss or movement of barite powder if the vessel is being loaded, and diverting the blower while loading the vessel.

6. The method of claim 1, further comprising a hose connection in an upper section of the vessel configured to allow for loading powder from another vessel of similar design, and loading powder from another vessel of similar design.

7. The method of claim 1, wherein the gently sweeping elbow has an angle of about 15 degrees to about 90 degrees.

8. The method of claim 1, further comprising a power system to operate the blower.

9. The method of claim 1, further comprising a removable funnel shaped hopper, wherein the hatch fitted to the top of the vessel allows for the removable funnel shaped hopper to be connected to the vessel.

10. The method of claim 1, wherein the bulk barite particles are a mixture of barite particles with a size of about 1 micron and a blend of small barite particles, wherein the D50 of the mixture is not greater than about 325 mesh.

11. A well treatment system comprising:

a well treatment apparatus comprising a superstructure including a conveying system, configured to pneumatically convey bulk barite including:

a cylindrical vessel with a conical bottom section and an opening near the base of the cone;

an air blower with an inlet and an outlet, said air blower attached to the superstructure adjacent the opening of the cone, wherein the inlet of the air blower is in fluid communication with the opening near the base of the cone and the air blower is configured to produce air velocities of at least about 40 ft/min;

an air assisted puffer device inside the cylindrical vessel near the base of the cone;

a gently sweeping elbow of about 15 degrees to about 90 degrees in fluid communication with the blower outlet and attached downstream of the air blower outlet; and a hatch fitted to the top of the vessel that allows for a removable funnel shaped hopper to be connected to the vessel thereby allowing bulk barite to be loaded into the top of the vessel from bulk bags, wherein the bulk barite comprises particles at least about 1 micron in size at D50 distribution up to about 6 microns in size at D50 distribution.

12. An apparatus comprising a superstructure including:

a cylindrical vessel with a conical bottom section and an opening near the base of the cone;

an air assisted puffer device inside the cylindrical vessel near the base of the cone;

an air blower with an inlet and an outlet, said air blower attached to the superstructure adjacent the opening of the cone, wherein the inlet of the air blower is in fluid communication with the opening near the base of the cone and the air blower is configured to produce air velocities of at least about 40 ft/min;

a gently sweeping elbow in fluid communication with the blower outlet and attached downstream of the air blower outlet;

a hatch fitted to the top of the vessel allowing bulk barite powder to be loaded into the top of the tank from bulk bags; and a removable funnel shaped hopper, wherein the hatch fitted to the top of the vessel allows for the removable funnel shaped hopper to be connected to the vessel.

* * * * *